United States Patent [19]

Swain et al.

[11] 4,186,637

[45] Feb. 5, 1980

[54] TONE GENERATING SYSTEM FOR ELECTRONIC MUSICAL INSTRUMENT

[75] Inventors: Richard S. Swain, Des Plaines; Douglas R. Moore, Vernon Hills, both of Ill.

[73] Assignee: Norlin Industries, Inc., Lincolnwood, Ill.

[21] Appl. No.: 835,832

[22] Filed: Sep. 22, 1977

[51] Int. Cl.[2] ..... G10H 1/00; G10H 1/02; G10H 5/06

[52] U.S. Cl. ..... 84/1.01; 84/1.25; 84/1.24; 84/DIG. 2; 84/DIG. 4; 84/DIG. 11

[58] Field of Search ..... 84/1.01, 1.24, 1.25, 84/1.26, DIG. 2, DIG. 8, DIG. 22, DIG. 23, 1.03, DIG. 4, DIG. 11

[56] References Cited

U.S. PATENT DOCUMENTS

| | | | |
|---|---|---|---|
| 3,610,799 | 10/1971 | Watson | 84/1.26 |
| 3,766,305 | 10/1973 | Schrecongost | 84/1.01 |
| 3,809,786 | 5/1974 | Deutsch | 84/1.01 |
| 3,824,326 | 7/1974 | Obayashi | 84/1.25 |
| 3,828,109 | 8/1974 | Morez | 84/1.01 |
| 3,898,905 | 8/1975 | Schreier | 84/1.01 |
| 3,929,053 | 12/1975 | Deutsch | 84/1.24 |
| 3,951,030 | 4/1976 | Deutsch | 84/1.25 |
| 4,041,825 | 8/1977 | Pascetta | 84/1.01 |
| 4,065,993 | 1/1978 | Hirose | 84/1.03 |
| 4,122,744 | 10/1978 | Uetrecht | 84/1.25 |
| 4,128,032 | 12/1978 | Wada et al. | 84/1.01 |

*Primary Examiner*—B. Dobeck
*Assistant Examiner*—Forester W. Isen
*Attorney, Agent, or Firm*—Ronald J. Kransdorf; Jack Kail

[57] ABSTRACT

This invention relates to tone generating systems for polyphonic electronic musical instruments. The system includes a plurality of programmable tone generators each of which is assigned to a different note to be sounded. For a preferred embodiment, one of the programmable tone generators is designated as a solo high tone generator, and is always utilized to produce the highest note to be sounded. Another generator may be designated as the solo low generator, and will always be utilized to generate the lowest note to be sounded. Additional solo note generators may be provided if desired. Tone generators are interconnected in a priority scheme with one generator at a time being designated as the next generator to be assigned a note to be sounded, and the designation being advanced in a predetermined manner as notes are assigned successively to the generators. One or more keyers are associated with each programmable tone generator, and receive a keyer enable signal from the tone generator when a note to be sounded is stored therein. Each generator also generates one or more pulse code outputs to its corresponding keyers, programming them to adapt to the selection of musical notes over a multi-octave range. Phase cancellation between two notes which are octavely related is avoided by duplicate generation of one of the notes in both master and slave tone generators, the code for any note being stored in both the master and slave generators whenever it is determined that the code for an octavely related note is already stored in another master generator. Various special effects are achieved by selectively dropping pulses from the clock signal applied to the programmable divider of the generator.

21 Claims, 12 Drawing Figures

HF CLOCK
CONTROL SWITCHES & STOPS
PRIORITY TONE GENERATORS
SOLO TONE GENERATORS
KEYERS
KEYERS
VOICING CIRCUITS
VOICING CIRCUITS
AMPLIFIER
AMPLIFIER
KEYBOARD CIRCUIT
SCAN CLOCK
SCANNING MULTIPLEXER
SYNC.
TIMING PULSER (TP'S)
10
12
14
16
18
20
22
24
26
28
30
32
32
36
38
38
40
40
46
48
50
50
54
54
58A
58B
60A
60B
62
64
66

KEYER
SLAVE CONTROL
OCTAVE CODE
CARRY OUT
CARRY IN
ENABLE
PULSE CODE
SLAVE
SLAVE
MASTER
MASTER
SOLO HI
SOLO LOW
TO KEYER
TO KEYER
TO KEYER
TO KEYER
TP1
TP2
TP3
TPA
SPECIAL FUNCTION CONTROLS
SPECIAL FUNCTION CONTROLS
CARRY OUT
COPY IN
R/S
CONT
STATUS
DATA
SYNC
SCCI
HPCI
+V COPY OUT
GD. CARRY IN

FIG. 10A
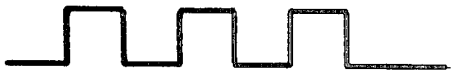
FIG. 10B
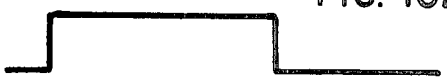
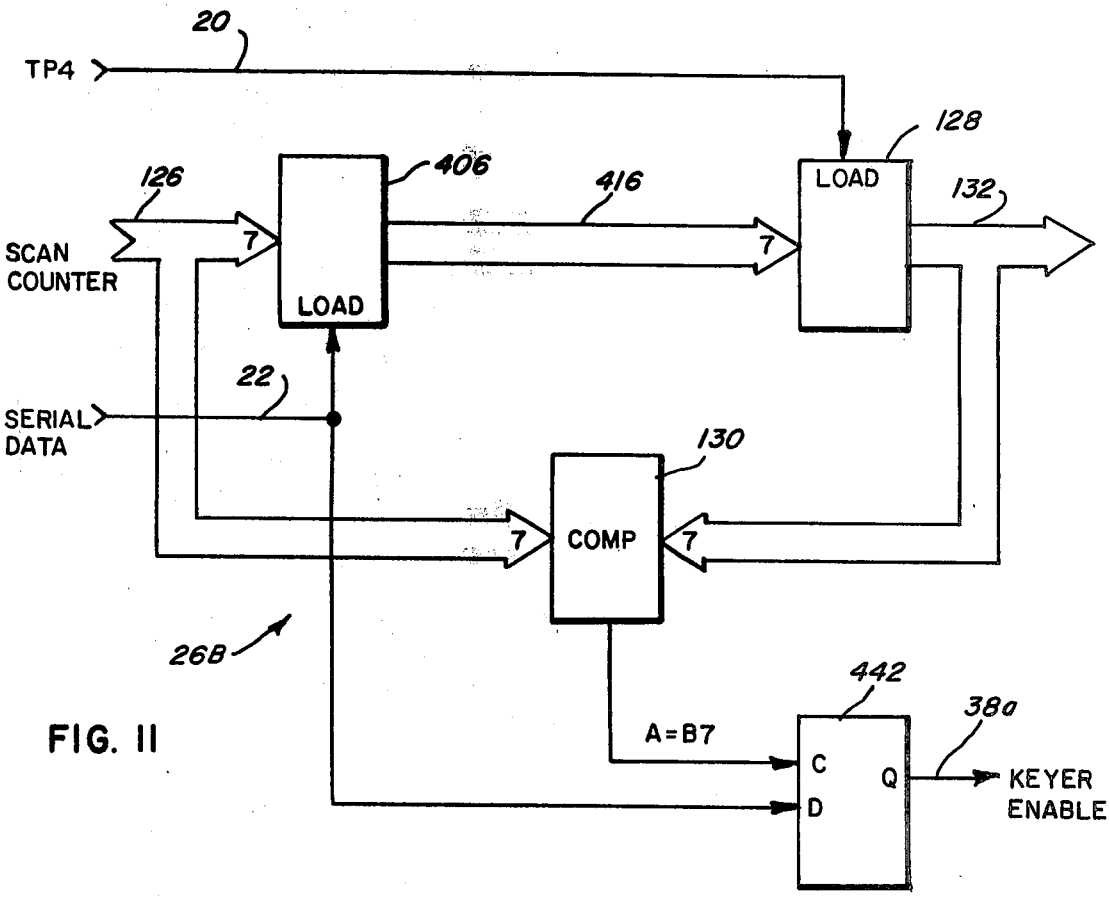
FIG. 11

TONE GENERATING SYSTEM FOR ELECTRONIC MUSICAL INSTRUMENT

GENERAL DESCRIPTION

1. Field of the Invention

This invention relates to electronic musical instruments, and, more particularly, to a polyphonic tone-generating system for such instruments.

2. The Prior Art

Tone generators for electronic musical instruments such as organs or synthesizers have heretofore been of two general types. Synthesizers have generally utilized a voltage-controlled oscillator, the control voltage applied thereto being a function of the note to be sounded. These systems are monophonic, being adapted to sound only a single note at a time. Organs have normally utilized either a separate oscillator for each note which is to be generated or a single oscillator which is passed through suitable dividers to obtain outputs at each frequency which the instrument will be required to sound. Each output frequency from these tone generators is applied to a separate keying circuit, which controls the attack, decay, and other characteristics of the note to be sounded. Thus, if the instrument is adapted to sound 61 different notes, 61 keying circuits would be required. However, for chorus and other special effects, additional keyers may be required. Additional keyers may also be required to process wave forms having different shapes. Thus, it is not uncommon to have as many as three to five keyers per note, or up to 305 keyers in a sophisticated instrument.

This additional circuitry significantly increases the size, weight, complexity, power consumption, and cost of the instrument. However, because of the way music is written, and, more particularly, the limited number of fingers and feet that a person may utilize to operate pedals and keys on a keyboard or other note selection device, it is not necessary that more than ten or a dozen notes be sounded at any given time. Therefore, when a priority scheme is available for assigning notes to keyers and related circuitry, only a limited number of sets of these circuits, nor more than 12, would be required. One way to accomplish this is to utilize a limited number of programmable tone generators, equal to the maximum number of notes to be sounded simultaneously, with a like number of keying and associated circuits assigned to respective programmable tone generators. There have been a number of such programmable tone generator systems in the past, as exemplified by U.S. Pat. No. 3,610,799 of Watson and U.S. Pat. No. 4,016,495 of Machanian.

One problem encountered when utilizing a programmable tone generator with a keying circuit is that certain functions of the keyer are frequency-dependent. Where a keyer is exclusively dedicated to one note, it can be designed exclusively for the required frequency. But when the keyer may be called upon at any time to operate on any note within the range of the instrument, its parameters must be rapidly adjustable on demand. Copending application Ser. No. 835,695 entitled "Tone Generating System for Electronic Musical Instrument" filed on behalf of Glenn Gross on Sept. 22, 1977 and assigned to the assignee of this invention, teaches programmable keying and other circuitry suitable for use with programmable tone generators. These keyers require activating signals and various types of pulse-coded signals which designate the octave or half octave of the note to be sounded. Therefore, programmable tone generators must be adapted to produce these program control outputs.

Another problem which may arise with programmable tone generators is that the phase relationship between the same note in two different octaves can not be controlled, unlike standard tone generator systems. If two such notes should happen to be sounded 180° out of phase, phase cancellation occurs, resulting in aesthetically unpleasing gaps in the output. Means must therefore be provided for preventing such phase cancellation from occurring.

A tone generator system should also have the capability of providing such special output effects as chorus, vibrato, arpeggio and glide, these effects being provided as simply and inexpensively as possible.

Another feature which is desirable is the capability of voicing selected notes differently from the remaining notes. For example, it may be desired to voice the highest frequency note, which is normally the melody note, differently from the lower, or harmony, notes. Or, in some cases, it may be the lowest note on the upper keyboard, rather than a higher note, which is to be voiced differently. Similarly, the lowest note to be sounded is normally the bass or pedal note; and it may be desired to voice this note differently from the remaining notes. In order to provide the flexibility of voicing selected notes differently, the system should provide certain special programmable tone generators which will always sound a selected note, for example, the highest note to be sounded or the lowest note to be sounded, the output from these generators being applied through different voicing circuitry than the outputs from the remaining tone generators.

A need therefore exists for a relatively simple and inexpensive tone generating system utilizing a plurality of programmable tone generators. Such a system should be adapted to generate required control outputs to programmable keyers, should have the capability of assigning certain generators to selected notes which may then be passed through different voicing circuits, should be able to overcome the phase cancellation problem, and be adapted for certain special effects including chorus, vibrato and glide.

SUMMARY OF THE PRESENT INVENTION

This invention provides a tone-generating system for a polyphonic electronic musical instrument of the type having player-operating means for generating an indication of the note or notes to be sounded. The generator system includes a plurality of programmable generators, each of which has a storage means adapted to store a coded representation of a single note to be sounded, and a programmable divider. There is also a means, responsive to an indication that a note is to be sounded, for storing a coded representation of the note in at least a selected one of the storage means, and a source of high frequency clock signals. Each of the programmable dividers is adapted to receive the clock signal and to divide the signal be a factor which is a function of the code stored in the corresponding storage means, to produce an output signal at the frequency of the note having its code stored in the storage means.

Means are also provided for storing a predetermined note to be sounded, such as the highest note, or the lowest note, in a particular storage means so that the output from the corresponding generator may be voiced or otherwise treated in a special manner.

The output from each programmable tone generator is applied to a corresponding keyer or keyers. Means are provided in each generator for producing a keyer enable signal when the code for a note to be sounded is stored therein, and for generating a code output for the keyer, representing octave information stored in the generator storage means.

The system also includes means for inhibiting phase cancellation which may occur between two and more octavely related notes to be sounded. For a preferred embodiment, this means includes a second plurality of programmable tone generators, the code for a note being stored in a storage means of a tone generator of the second plurality as well as in the storage means of a tone generator of the first plurality when the note is octavely related to a note whose code was previously stored in a storage means of a generator of the first plurality.

The system also includes means for selectively dropping clock pulses from the clock signal utilized by at least some of the programmable tone generators. When this is done during alternating cycles of the programmable divider, it permits the number of possible note frequencies to be doubled without increasing the clock frequency of the source. Selective dropping of a predetermined number of clock pulses, the number depending on the octave information stored in the corresponding storage means, causes a variation in frequency of the output from the generator at a predetermined beat rate, resulting in a chorus effect. By providing means for periodically increasing and decreasing the number of clock pulses which are dropped at a relatively low frequency, a vibrato effect may be obtained. Finally, by providing means for increasing or decreasing the number of clock pulses, which are dropped at a relatively linear rate, a glide effect may be obtained.

The foregoing and other objects, features and advantages of the invention will be apparent from the following more particular description of a preferred embodiment of the invention, as illustrated in the accompanying drawings.

BRIEF DESCRIPTION OF THE DRAWINGS

FIGS. 10A and 10B show some operating waveforms of the circuit of FIG. 9.

FIG. 11 is a functional block diagram of a portion of a solo low note generator.

GENERAL CIRCUIT DESCRIPTION

Figure 1:
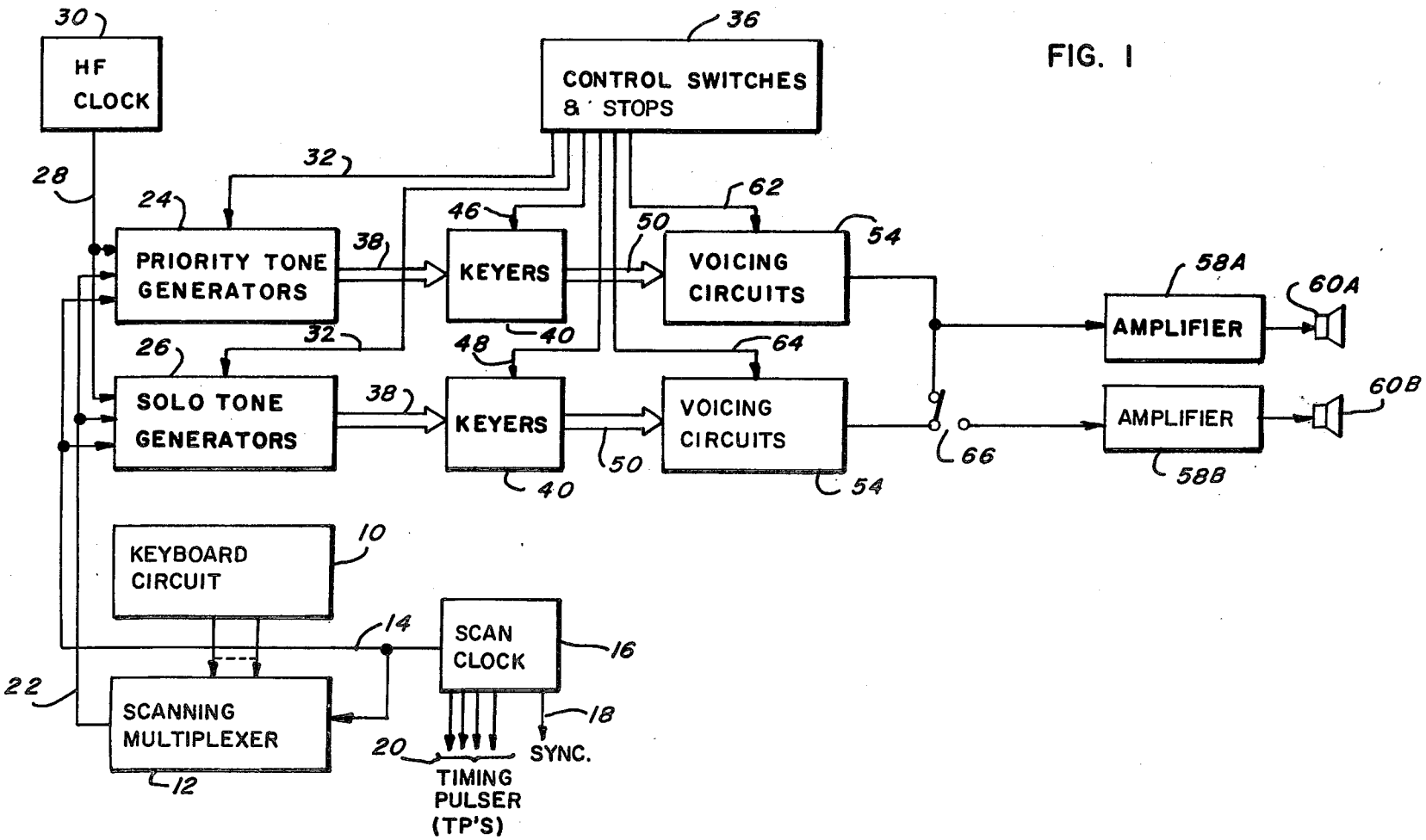
FIG. 1 is a function block diagram of a polyphonic electronic musical instrument utilizing the tone generating system of this invention.

Referring to FIG. 1, a polyphonic electronic musical instrument comprising an illustrative embodiment of the tone-generating system of this invention is shown. The tone generating system may be utilized with a variety of instruments, and does not require any particular manner of note selection. But for purposes of this description, it will be assumed that the instrument is an electronic organ, in which note selection is performed by means of a keyboard circuit 10. The latter includes a plurality of keys (sixty-one, for instance) respectively associated with a plurality of notes of a musical scale. The keys are individually, manually operable by a player of the instrument. At least one switch or other suitable indicating element is provided for each key, which changes state when its key is operated. The states of these switches are periodically scanned by a scanning multiplex circuit 12 at a rate controlled by a scan clock signal on an output line 14 of a scan clock 16. In the embodiment described herein, the key switches are scanned from the highest note on the keyboard to the lowest note.

Scan clock 16 also generates a sync pulse on line 18 at the beginning of each scan cycle, and successively generates a plurality of timing pulses (TP's) on a plurality of timing pulse output lines 20. One group of timing pulse outputs TP1-4 is provided for each clock cycle of a single scanning operation. Multiplexer circuit 12 produces a serial data pulse on its output line 22 each time it scans an operated key switch of circuit 10. Each pulse appearing on line 22 together with the scan clock pulse associated therewith thus constitutes a coded representation (in pulse position modulation code) of a note to be sounded. While the details of keyboard circuit 10 and scanning multiplexer 12 do not form a part of the present invention and are not described herein, for a full description of suitable circuitry for performing these functions, reference may be had to U.S. Pat. No. 3,902,397 issued on Sept. 2, 1975 to Eugene S. Morez, et al, entitled "Electronic Musical Instrument With Variable Amplitude Time Encoded Pulses", and assigned to the same assignee as this invention.

Output lines 14 and 22 are connected to a plurality of priority note (or tone) generators 24 and one or more solo note generators 26. As will be described in greater detail, the solo note generators function to produce one or more selected notes to be sounded, the highest note to be played or the lowest note to be played at any given moment, while the priority note generators 24 function to produce all of the notes which are to be sounded. Additional inputs to generators 24 and 26 are taken over a line 28 leading from a high frequency clock source 30, and output lines 32 from control switches and stops 36. These switches and stops are manually controlled elements that may be used to control a variety of instrument function. The signals appearing on lines 32 cause, in a manner to be described, such functions as chorus, vibrato, glide and arpeggio to be produced.

There are preferably 14 or 16 priority note generators 24 and two solo note generators 26. Each note generator 24 and 26 produces control output signals and tone output sigon a set of lines 38 which are applied to respective keyers 40. These keyers are programmable, and establish the attack and decay characteristics of the tone signal under control of signals on lines 46 and 48 from switches and stops 36. If the flexibility resulting from the provision of separate lines 46 and 48 is not needed, a single such line may be applied to both sets of keyers. Suitable programmable circuitry for use in the keyers 40 is shown in the before-mentioned copending application of Glenn Gross.

The audio output signals from keyers 40 appear on lines 50. These signals are applied through separate voicing circuits 54 to amplifiers 58 and speakers 60. Voicing circuits 54 operate in a standard fashion to vary the wave-shape and other tonal characteristics of the audio signal, under control of signals on lines 62 and 64, respectively, from switches and stops 36. A switch 66 is provided which, when in the position shown in FIG. 1, connects the outputs from both the priority note generators and the solo note generators to the same amplifiers 58A and speaker 60A. With switch 66 in the position opposite to that shown, the audio signals from the solo note generators are applied to a separate amplifier 58B and speaker 60B.

GENERAL DESCRIPTION OF NOTE GENERATORS

Figure 2:
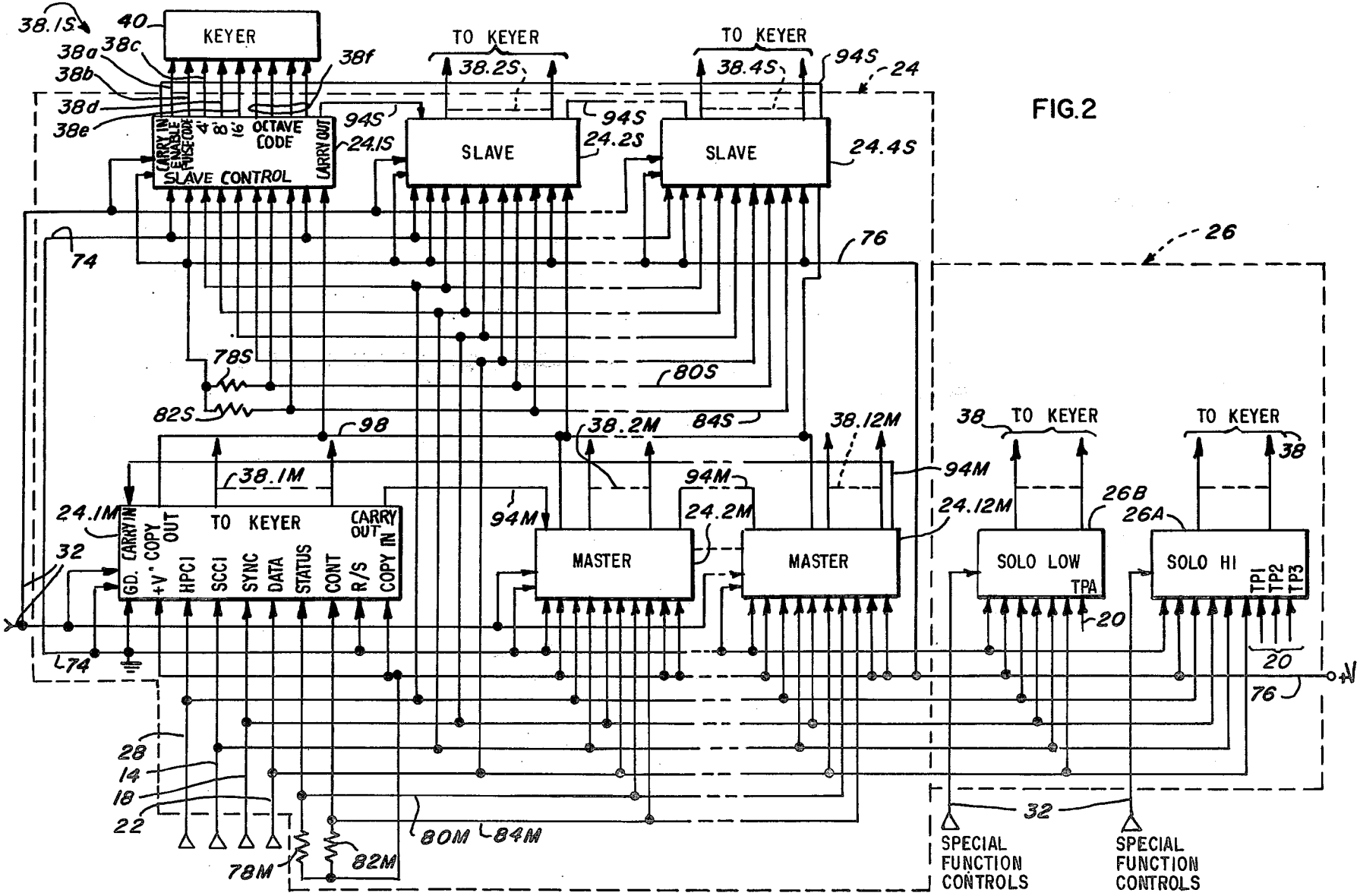
FIG. 2 is a schematic block diagram of a tone generator of a preferred embodiment of the invention.

Referring now to FIG. 2, a schematic block diagram of all the note generators 24 and 26 is shown. The priority note generators 24 include a first plurality (preferably ten or twelve) of master programmable tone generators 24.1M through 24.12M, and a second plurality of preferably four slave programmable tone generators 24.1S through 24.4S. Solo note generator circuit 26 comprises a single solo high generator 26A and a single solo low generator 26B.

Each of the generators 24 and 26 has inputs respectively connected with scan clock line 14, scan sync line 18, serial data line 22, and high frequency clock line 28. Special function control lines 32 also connect to inputs of all the master and slave tone generators 24 and the two solo generators 26A and 26B. A ground line 74 and a positive voltage bus 76 are also connected to inputs of each of the generators. The positive voltage on line 76 is also applied through a resistor 78M to a status bus 80M and through a resistor 82M to a control bus 84M, buses 80M and 84M being conncted as additional inputs to each of the master generators 24M. The positive voltage on bus 76 is also connected through a resistor 78S to a status bus 80S and through a resistor 82S to a control bus 84S. Buses 82S and 84S, in turn, are connected to additional inputs of each of the slave generators 24S.

The potential on status bus 80M is grounded when the note being sampled is the same as any note currently being generated by one of the master generators 24M. Similarly, status bus 80S goes to ground when the note being sampled is the same as any note currently being generated by one of the slave generators 24S. Control bus 84M goes to ground when an attempt is made to store a note code in any master generator 24M which has been selected as the next master generator in which a code is to be stored. The same is true for bus 84S in relation to any slave generator 24S.

Additional inputs to solo generators 26A and 26B are timing pulses from scan clock 16 (FIG. 1) produced on selected timing pulse lines 20. Solo high generator 26A receives timing pulses TP1, 2 and 3, and solo low generator 26B receives timing pulse TP4.

Each of the master generators 24M has a carry output connected through a line 94M to a carry input of the next succeeding master generator 24M, and the carry output of the last master generator 24.12M is coupled to the carry input of the first master generator 24.1M. Similarly, the carry output of each of the slave generators 24.S is connected through a line 94S to the carry input of the next succeeding slave generator 24S, and the carry output from the last slave generator 24.4S is connected to the carry input of the first slave generator 24.1S.

A reset input on each of the generators 24, except for the first generators 24.1S and 24.1M, is connected to positive bus 76. The reset inputs for the first generators 24.1S and 24.1M are connected to ground bus 74. As a result of these connections, when power is turned on, suitable indicators are set in the first generators 24.1S and 24.1M, indicating that the code of the first note played should be stored therein. When that note has been stored in the first master generator 24.1M, a signal appears on control bus 84M which, in conjunction with the signal appearing on carry output line 94M from the first master generator 24.1M, causes the indicator in that generator to be reset and the indicator in the second master generator 24.2M to be set. The code for the next note played is thus stored in the second master generator, resulting in a signal on control bus 84M which causes the indicator in the second master generator 24.2M to be reset and the indicator in the next succeeding master generator to be set. This continues until all master generators 24.1M, 24.2M . . . have been assigned except the last master generator 24.12M. At this time there is an output on carry line 94M from the last master generator 24.12M which would normally cause the indicator in the first master generator 24.1M to be set the next time a signal appears on control bus 84M. However, if the note having its code stored in the first master generator 24.1M is still being sounded, a mechanism is provided, described hereinafter, for sampling each succeeding master generator 24.1M, 24.2M . . . in order until one is found which is storing the code for a note that is not still being sounded. The indicator in this generator is then set. Selection of a slave generator 24S to store the next note code to be stored is accomplished in the same manner as described above with regard to master generators 24M, but employing control bus 84S and carry lines 94S.

Each of the slave generators 24S and master generators 24M also has a slave control input which is connected to ground bus 74 for master generators 24M and to positive bus 76 for slave generators 24S. This enables the master and slave generators to function slightly differently, while utilizing the same circuitry for the sake of economy.

The final input to each of the master generators 24M is a copy input which is connected to positive bus 76. Each of these master generators also has a copy output, which is connected to a copy bus 98. The copy bus is connected to a copy input of each of the slave generators 24S. A signal appears on the copy output of one of the master generators 24M, and thus on bus 98, when it is detected that the next note to be stored in one of the master generators 24M is octavely related (i.e., represents the same note in some other octave) to a note code stored in any other master generator 24M which is still generating an output. This signal on line 98 fully enables the next slave generator 24S which is to have a note code stored therein. The selected slave generator 24S then proceeds to store the same note code currently being loaded into the said master generator 24M. As a result one of the octavely related notes is then generated both by one of the slave generators 24S and one of the master generators 24M; while the other octavely related note is being generated only by another one of the master generators 24M. This means that at least three independent note generators 24 will be producing the two octavely related notes. Since all three generators cannot be 180° out of phase with each other, the possibility of phase cancellation between octavely related notes is totally precluded.

Each of the generators 24 and 26 has nine output lines 38 which are applied to the keying circuits 40. Only lines 38.1S of generator 24.1S are shown in detail. These include a keyer enable line 38*a*, a pulse width code line 38*b*, four foot, eight foot, and sixteen foot tone output lines 38*c*, 38*d* and 38*e*, respectively, and four octave code lines 38*f*. A signal appears on the keyer enable line 38*a* when the note code stored in the corresponding generator 24 is to be sounded. A variable width pulse coded program control signal is applied to line 38*b*, the pulse duty cycle being a function of the octave or half octave of the note to be sounded by the generator. The tone signal appearing on line 38*c* is the tone for the note stored in the generator, while the tone signals appearing on lines 38*d* and 38*e* are the tone signals for the notes one octave and two octaves lower, respectively. The lines 38*f* contain a program control signal comprising a bit-parallel coded representation of the octave and half octave for the note to be sounded by the generator. The manner in which the generators function to produce these outputs will now be described.

PRIORITY NOTE GENERATOR

Figure 3:
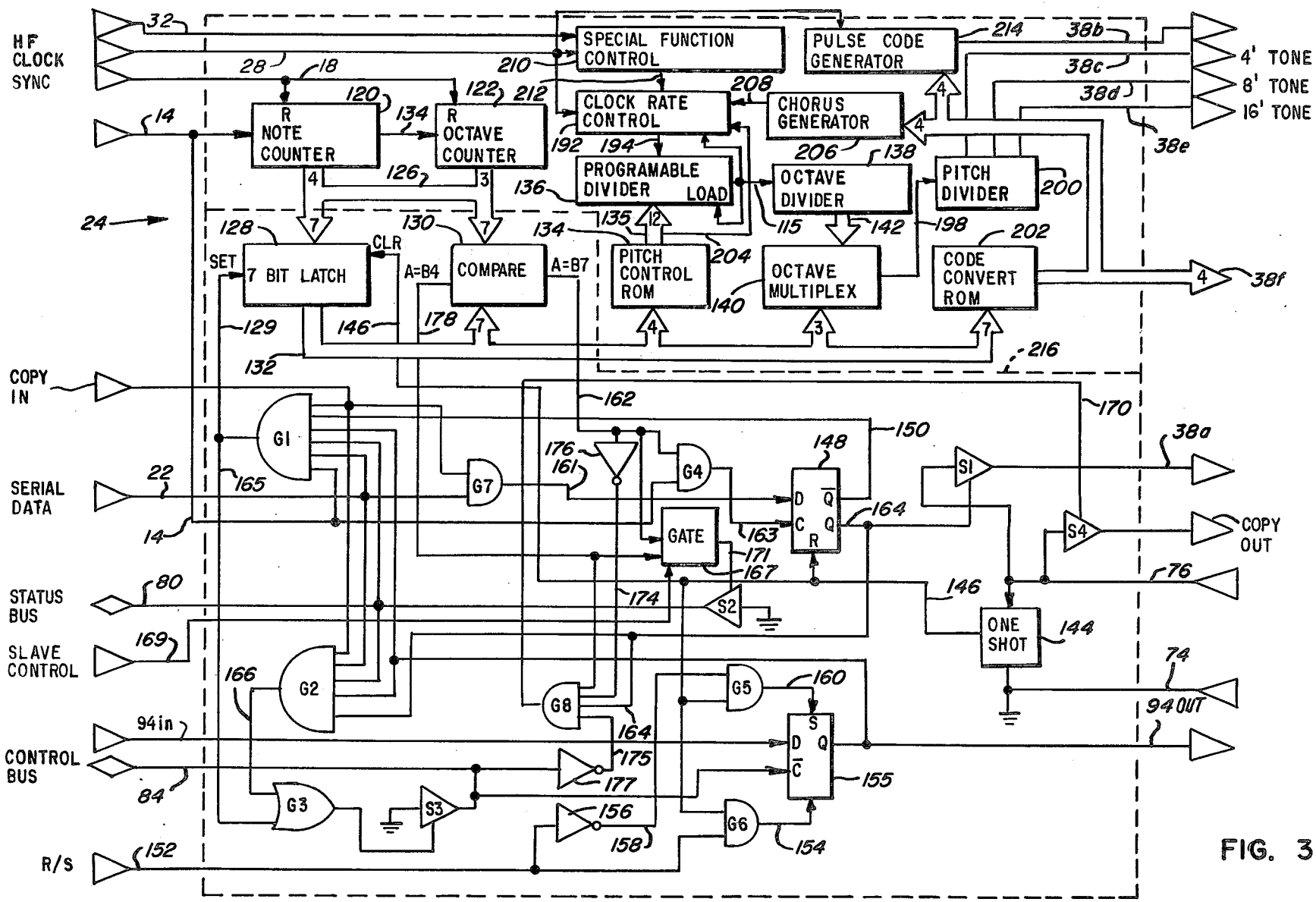
FIG. 3 is a logical and functional block diagram of a single priority note generator shown in FIG. 2.

FIG. 3 is a schematic diagram of any one of the master or slave priority note generators 24M or 24S. A sync pulse on line 18 is applied to the reset inputs of a four-bit present note counter 120 and three-bit present octave counter 122 to reset them both to zero at the beginning of each cycle of scan clock 16 (FIG. 1). Clock pulses on scan clock line 14 are applied to a count input of note counter 120. The latter counts these pulses and when the count reaches twelve, the counter resets to zero. Upon reset a pulse is generated on a line 134 and applied to a count input of the octave counter 122 to increment it by one count. The count presently appearing in counter 122 thus represents the octave in which the note presently scanned is located, and the present count of counter 120 identifies the note within that octave. During generating of each pulse on serial data line 22, the present seven-bit code (corresponding to the key switch associated therewith) is provided on output lines 126.

Lines 126 are connected to information inputs of a seven-bit assigned note and octave code storage latch 138 and a compare circuit 130. The latch 128 stores the assigned note and octave code, and provides it on seven lines 132 to the compare circuit 130. The compare circuit 130 compares the stored code on lines 132 with the current code on lines 126, and controls subsequent circuitry in accordance with the comparison, as will be described. The seven bits on lines 132 are also connected to an octave and half octave code translator 202, which translates the seven-bit format into a four-bit parallel code format which is required by a particular embodiment of the keyers 40, and makes this available to the keyers on output lines 38*f* (see FIG. 1).

The seven outputs 132 of code latch 128 are selectively connected to other elements of the priority note generator. A control ROM (read-only memory) 134 receives four of the seven latch outputs 132, representing stored note information. In response to this information, the ROM 134 provides control signals over a cable 135 to a programmable note divider 136 for a purpose which will be explained. The other three of the latch outputs 132, containing stored octave information, are applied to an octave multiplex circuit 140. The octave multiplexer chooses one of several outputs 142 from an octave divider circuit 138, depending on the octave of the note to be generated.

When power is turned on to the circuit 24M, the supply voltage on bus 76 causes a power-on-reset (POR) one-shot circuit 144 to generate a pulse on line 146 which is applied to reset a keyer enable flip-flop 148. This disables the keyer enable function, and results in a 1-state signal appering on $\overline{Q}$ output line 150. The POR pulse on line 146 is also applied to a clear input of code latch 128 which causes it to reset to zero.

POR output 146 is also applied to one input of a priority assignment AND gate G5 and to one input of a cancel assignment AND gate G6. At this time the R/S input on line 152 to each of the priority note generators 24, except the first master and first slave generators 24.1M and 24.1S (see FIG. 2), is in logic 1-state to enable the cancel assignment gate G6. That gate, when enabled, passes the line 146 pulse to its output line 154, which applies it to reset a priority assignment flip-flop 155. The first generators 24.1M and 24.1S, on the other hand, each have a 0-state signal applied to their respective lines 152 that causes their respective inverters 156 to generate a 1-state signal on their respective output lines 158. This 1-state signal is applied to enable their respective priority assignment gates G5 to pass the line 146 pulses to output lines 160 so as to set their priority assignment flip-flops 155. This results in a 1-state signal appearing on the Q output line of the priority assignment flip-flops 155 of the first generators 24.1S and 24.1M only. The output lines of the flip-flop 155 are the carry output lines 94-out of the respective circuits 24 (see FIG. 2).

Nothing further happens until, during a scan of keyboard circuit 10 (FIG. 1), a key switch closure is detected, resulting in a serial data pulse appearing on line 22. This pulse is applied to one input of a serial data AND gate G1. Two further inputs to this gate are taken from lines 150 and carry output line 94 out. Three remaining inputs to gate G1 are the copy-in line (which, in the case of each slave generator 24S, is tied to the positive bus 76), scan clock line 14 which will have a 1-state signal on it during the serial data pulse on line 22), and status bus 80 (which normally has a positive potential applied thereto from line 76 through a resistor 78, FIG. 2). All of these inputs are then in a 1-state, and data gate G1 thus responds to the first serial data pulse appearing on line 22 by passing a 1-state signal to its output line 165. This pulse is applied to a load or store input line 129 of the assigned note and octave code storage latch 128, causing the present note and octave code then appearing on lines 126 from the present note counter 120 and present octave counter 122 to be entered into storage in the latch 128. This AND gate output pulse is also applied to priority assignment OR gate G3 which in response thereto enables switch S3 to apply a 0-state signal to control bus 84.

When a serial data pulse appears on line 22 during a signal on copy-in line for the master generators 24M, a copy-in AND gate G7, having two inputs connected to the serial data line 22 and the copy-in line respectively, passes a pulse to output line 161. Output line 161 is connected to the D input of keyer enable flip-flop 148, and the pulse thereon causes the flip-flop 148 to switch to its set state, producing a 1-state signal on its Q output line 164. This 1-state signal on line 164 is applied to switch S1, causing it to pass the positive potential from bus 76 to keyer enable output line 38*a*. As long as keyer enable flip-flop 148 remains set, a positive keyer enable signal is applied to each keyer 40 associated with the generator 24 (see FIG. 2).

After the keyer enable flip-flop 148 has been set, during each subsequent scan cycle of clock 16, a time will arrive when the count in the present note and octave counters 120 and 122 is equal to the assigned note and octave code stored in latch 128. When this occurs, the compare circuit 138 generates a repeat note compare pulse on its A-B7 output line 162. This compare output is connected to a repeat note AND gate G4, and the compare pulse enables it to pass a scan clock pulse to its output line 163 connected with the C input of keyer enable flip-flop 148. If the generator 24 is a master unit 24M, its gate G7 is continuously enabled by the positive voltage on bus 76 which is connected to the copy-in line of all master generators 24M (see FIG. 2). Therefore, any serial data pulse on line 22 will transit the gate G7, and become the D input of flip-flop 148. If the corresponding key is still depressed, there will be a serial data pulse on lines 22 and 161 at this time, and the resulting 1-state pulse at the D input will cause keyer enable flip-flop 148 to remain in its set state. The keyer enable signal will therefore remain on line 38*a*.

However, if the key corresponding to the note stored in the latches 120 and 122 of the generator 24 has been released, a signal will no longer appear on serial data line 22 at this time. When this happens, the resulting 0-state input signal on gate G7 output line 161 to the D input of keyer enable flip-flop 148 will be transferred to the Q output of the flip-flop, resulting in a 1-state signal on $\overline{Q}$ output line 150. This terminates the keyer enable signal from the generator on line 38*a*. As will be seen shortly, this also indicates that the generator 24 is available to generate another note.

Control bus 84 is applied to the $\overline{C}$ input of priority assignment flip-flop 155. When ground potential is applied to its $\overline{C}$ input, the potential appearing at its D input is transferred to its Q output. Thus, since a 0-state is initially applied on carry input line 94-in to the D input of flip-flop 155 of the first master or slave generator 24.1M or 24.1S, the first time that a ground potential is applied to bus 84M or S (as a result of the serial data gate G1 in the first generator 24.1M or 24.1S being fully conditioned), this flip-flop is reset to its $\overline{Q}$ state, disabling the serial data gave G1 of generator 24.1M or 24.1S. However, there is a ONE (i.e. positive potential) appearing on carry output line 94-out of the first generator 24.2M or 24.1S, which is applied to carry input line 94-in of the second generators 24.2M or 24.2S. Thus, priority assignment flip-flop 155 in circuit 24.2M or 24.2S is set to its Q state, enabling serial data gate G1 therein. Thus, the next time, either during the same scan cycle or a subsequent scan cycle, that a serial data bit appears on line 22, the serial data gate G1 in generator 24.2M or 24.2S will be fully enabled to generate an output on line 164, causing the code for this note to be stored in latch 128 of that generator, and causing the priority assignment flip-flop 155 in that generator, and causing the priority assignment flip-flop 155 in that generator 24.2M or S to be reset and the priority assignment flip-flop 155 in the next succeeding generator 24M or S to be set.

This sequence of operation continues with the priority assignment flip-flops 155 for succeeding priority note generators 24M or S being enabled as note codes are stored in the preceding generators 24M or S until, when a note code is stored in the last generator 24.12M or S, the priority assignment flip-flop 155 for the first generator 24.1M or S is again set to its Q state. When this happens, the signal appearing on carry output line 94-out of generator 24.1M or S is applied as one input to a bus gate G2, as well as serial data gate G1. The next time serial data appears on line 22, this signal is applied to both gates G1 and G2. If keyer enable flip-flop 148 is in its $\overline{Q}$ state, indicating that the note assigned to be generated by generator 24.1M or S is no longer to be sounded, then a signal appears on $\overline{Q}$ output line 150 from this flip-flop, fully enabling serial data gate G1 at this time in order to store the code for a new note in storage latch 128, and the setting of priority assignment flip-flops 155 is advanced to the next generator 24.2M or S in the manner previously described.

However, if keyer enable flip-flop 148 is still in its Q state, indicating that the note assigned to generator 24.1M or S is still to be sounded, a signal appears on Q output line 164 from this flip-flop, fully conditioning bus gate G2 to generate an output on line 166 which is passed through priority assignment OR gate G3 to enable switch S3 to put a ground potential on control bus 84. This results, in a manner previously described, in the priority assignment flip-flop 155 for the first generator 24.1M or S being reset and the priority assignment flip-flop 155 for the second generator 24.2M or S being set, without causing the note code to be stored in the latch 128 for generator 24.1M or S.

The next time a serial data bit for a note not stored in any generator 24M or S appears on line 22, either later in the same scan cycle or during the next scan cycle of clock 16, an attempt will be made to store the code for the corresponding note in the latch 128 of generator 24.2M or S. Again, depending on the state of the flip-flop 148 of generator 24.2M or S, the code will either be stored in its latch 128 and the setting of flip-flops 155 advanced to the next generator, or the setting of flip-flops 155 will be advanced to the next generator without permitting the note code to be stored in generator 24.2M or S. This sequence of operations is repeated until an available generator 24M or S is found and the note code stored therein.

While from the above it is apparent that several cycles may be required in order to find a circuit 24M or S in which to store information corresponding to a new activated key, this is not a problem since the scan rate is several tens of thousands of scan cycles per second, much faster than the attack time of keyers 40, and, therefore, even if the maximum number of ten or twelve scan cycles is required in order to find an empty circuit 24M, this will not be audibly detectable. From the above, it is apparent that all of the priority assignment flip-flops 155 in the twelve circuits 24M or the four circuits 24S perform as a twelve-bit or four-bit shift register which shifts a single bit, initially entered in flip-flop 155 of generator 24.1M or S, through the twelve or four flip-flops, shifting occurring each time a ground potential appears on control bus 84M or S.

Once any master generator 24M, or any slave generator 24S, has been assigned to generate a particular note, no second master generator 24M and no second slave generator 24S should be redundantly assigned to generate the same note. This is the function of status bus 80 which is connected as an input to both gates G1 and G2. From FIG. 2, it is seen that there is normally a positive potential on this line from positive bus 76 through resistor 82, which enables the storage of a new note code by a generator 24. However, special steps are taken to change the potential on status bus 80 when the note code should not be stored; i.e. when the note presently being scanned has the same code (the counts in present note and octave counters 120 and 122) as the assigned note and octave code stored in latch 128. Under those circumstances, when the compare circuit 130 for that generator 24 produces an output on a seven bit (A=B7) line 162, it is blocked by a redundancy gating circuit 167. Gating circuit 167 has the property that it passes the input signal on comparison line 162 to its output line 171 if there is a ground potential input on a slave control line 169, and passes the input signal on a four bit (A=B4) comparison line 178 to output line 171 if there is a positive input potential on slave control line 169. Since for any master generator 24M, as previously indicated, there is a ground potential on slave control line 169 (see FIG. 2), the comparison signal on line 162 enables switch S2 to apply ground potential to status bus 80M. The ground potential on status bus 80M disables both gates G1 and G2 for all of the master generators 24M, preventing the code for the presently scanned note from being redundantly stored in any master generator 24M, including, in particular, the next generator 24M which has its priority assignment flip-flop 155 in the Q state.

This is true even if the key corresponding to the presently scanned note has been released, causing the keyer enable flip-flop 148 in the corresponding note generator 24M to be reset to its Q state, and then the key was depressed again before a new note code is stored in the latch 128 of the generator. The first time that a serial data bit appears on line 22 after the keyer has been redepressed, there will be a compare signal on line 162 which will cause ground potential to be applied to status bus 80M, preventing the code for this note from being redundantly stored in any other master generator 24M. The signal on line 162, in conjunction with the scan clock on line 14, fully conditions repeat note gate G4 to generate an output on line 163, causing the one bit now appearing on serial data line 22 and line 161 to be transferred to the Q output of keyer enable flip-flop 148, resulting in a continuance of the keyer enable output signal on line 38a in the manner previously described.

Figure 4:
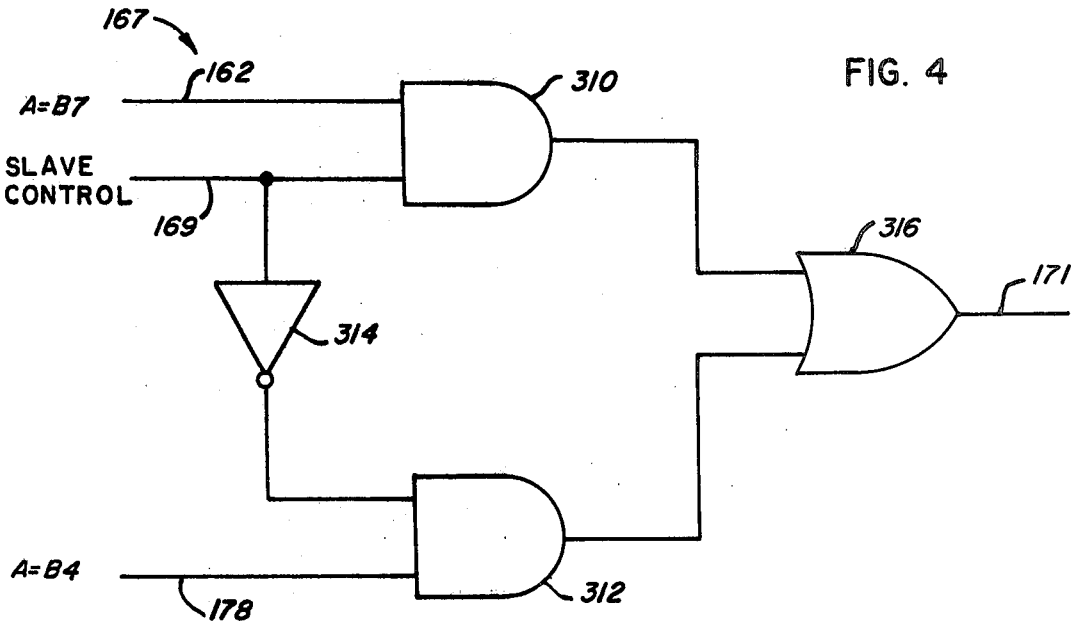
FIG. 4 is a logic diagram of a special function gate employed in the tone generator of FIG. 3.

The internal logic of redundancy gating circuit 167 is illustrated in FIG. 4. It comprises AND gates 310 and 312, and OR gate 316, and an inverter 314. The A=B7 comparison line 162 and the slave control line 169 are both required to satisfy gate 310. The gate 312 is satisfied by the A=B4 comparison line 178 and the inverse slave control signal from inverter 314. Either gate output 310 or 312 will transit the gate 316 and appear on output line 171.

As previously indicated, each master generator 24M has a copy-out output which is applied to bus 98. From FIG. 3, it is seen that a positive copy-out potential is available from positive bus 76 when the copy-out switch S4 is one of the circuits 24M has a positive potential applied to its gate input line 170 which carries the output from a copy-out AND gate G8. The inputs of copy-out gate G8 and Q output line 164 from keyer enable flip-flop 148, output line 174 from an inverter 176, output line 175 from an inverter 177, and the A=B4 comparison output line 178 from compare circuit 130. The input to inverter 176 is the A=B7 comparison output line 162 from the same compare circuit 130; and the input to inverter 177 is control bus 84. A signal appears on line 174 when the seven bits of note and octave information presented to comparator 130 are not all the same, but a signal appears on line 178 when only the four note bits outputted from note counter 120 are the same as the corresponding four bits stored in latch 128. Thus, copy-out gate 172 generates an output when the note portion of the present note code is the same as that already stored in the latch 128 for the generator 24M, but the octave of the note is not the same. This means that the note being sampled has the same musical letter designation A through G, and the same chromatic character, sharp, flat or natural, but is octavely related to the note stored, and an attempt is being made to store the present note in one of the master generators 24M (i.e. gate G1 or G2 in one of the generators is fully conditioned), and the note presently stored in the generator is presently being sounded. From previous discussion, it will be remembered that this is a condition under which it is desired to store a note in a slave generator 24S to duplicate the note of one of the master generators 24M.

The copy signal of bus 98 is, as was previously indicated, applied as an input through the copy-in line to gates G1 and G2 in each of the slave generators 24S, causing the present note code in the counters 120 and 122 to be stored in the assigned note latch 128 of the particular slave generator 24S having its priority assignment flip-flop 155 in the Q state at that time. When a code is stored in the latch 128 for a given slave generator 24S, a signal appears on its control bus 84, causing the priority assignment flip-flop 155 in that generator to be reset and the priority assignment flip-flop 155 in the next succeeding slave generator 24S to be set in the manner described above.

There are two other significant differences between the way a slave generator 24S works as opposed to the way a master generator 24M works. First, since, for any generator 24M or S, serial data is applied to the D input of keyer enable flip-flop 148 through copy-in gate G7, serial data will be passed to this flip-flop only if there is a positive level on the copy-in line. For master generators 24M this is always present, since this line is tied to positive potential bus 76 (FIG. 2). However, for slave generators 24S, there will only be a positive level on the copy-in line if one of the master generators 24M is applying a copy-out signal to bus 98. Therefore, while for a master generator 24M, keyer enable flip-flop 148 can only be reset if serial data is not appearing on line 22 at the clock time corresponding to the note code stored in latch 128, for a slave generator 24S the flip-flop 148 can also be reset if there is no signal on copy bus 98 at this time. The effect of this is that the slave generator 24S may be reset if either the note stored therein is no longer to be sounded or if the octavely related note which resulted in the note being stored in the slave generator is no longer being sounded.

The other difference is that, since there is a positive level on slave control line 169 for the slave generators 24S, redundancy gating circuit 167 is never able to apply the comparison input signals on A=B4 output line 178 (from compare circuit 130) to output line 171. This means that there is a ground potential on status bus 80S whenever the note stored in latch 128 is octavely related to (i.e. has the same note code but not the same octave code) as the note presently being sampled. This prevents two octavely related notes from being stored simultaneously in two of the slave generators 24S. The effect of the two differences noted above is that either one, or three or more, octavely related notes can be sounded simultaneously by the master and slave generators 24M and 24S, but two octavely related notes cannot. This prevents phase cancellation between two octavely related notes from occurring.

The slave generators 24S in all other respects function in an identical manner to the master generators 24M, except that in the slave generators 24S the copy-out output from gate S4 is open-circuited, and the copy-in input is connected to copy bus 98 rather than to power bus 76. Therefore, the same integrated circuit (differing only in external connections) may be utilized for both the master and slave generators 24.

As previously indicated, the four note bits stored in latch 128 are applied to control read-only memory (ROM) 134, the ROM storing a particular value for each possible note code. The value stored in the ROM, corresponding to the note stored in latch 128, is initially applied through lines 135 to the programmable note divider 136, which may typically be a multi-bit counter. The value in the counter is counted down under control of clock pulses received from clock rate control circuit 192 on line 194. The circuit 192 receives the high frequency clock pulses on line 28 and, under conditions to be described later, drops selected ones of these clock pulses in order to produce certain special output effects and for other purposes. When the value loaded into divider 136 has been counted down to a predetermined value, such as, for example, zero, an output pulse appears on line 115, and the value appearing on lines 135 is again loaded into the divider 136. Thus, pulses appear on line 115 at a divided frequency which is determined by the value loaded into divider 136 and the rate at which clock pulses appear on line 194. Except when variations are caused in the clock rate by circuit 192, the rate at which output pulses appear on line 115 corresponds to the frequency of the note portion of the code stored in latch 128 for the highest octave of the instrument.

Signals on line 115 are applied to octave divider 138, which is made up of a sequence of divide-by-two circuits, as many such circuits as the instrument has octaves; and the outputs from the divider stages appear on respective output lines 142. Thus, the output signals on lines 142 are at frequencies which correspond to the selected note in each of the octaves in which it may appear. The three octave code bits of those appearing on lines 132 are applied to octave multiplexer 140, which decodes the octave code, causing the audio frequency signal on only a selected one of the lines 142 to be passed to audio output line 198. Therefore, the signal appearing on line 198 is at the frequency of the particular note and octave stored in code latch 128. This signal is applied to pitch divider 200 which passes the signal on line 198 unchanged to a four-foot output line **38*c*, and also passes this signal through a pair of serially connected divide-by-two circuits, the output from the first of these circuits being the eight-foot output line 38*d* and the output from the second of the circuits being the sixteen-foot output line 38*e***.

The seven code bits on lines 132 are also applied to an octave and half octave code translator 202. The three octave bits on lines 132 are applied directly to three octave code output lines of the four in group **38*f*. The other four (i.e. note code) lines 132 are decoded by circuit 202 to determine in which half of the relevant octave the note appears, upper or lower; and a bit appears on the fourth octave code output line of group 38*f*** only if the note is in the lower half of its octave.

One input to the clock rate control circuit 192 is a single bit output line 204 from control ROM 134. A signal appears on this line when certain selected notes are to be produced by the generators 24M or S, the frequencies of these notes being non-integral sub-multiples, for example, two-thirds, of the clock frequency. In order to produce these notes with integral division (e.g. division by three) of the clock frequency, a clock having twice the frequency of source 30 would normally be required. Since the cost of such a high frequency clock is substantially greater than that of a lower frequency clock, a technique has been developed in accordance with the teachings of this invention for permitting these note frequencies to be generated using the lower frequency clock. The signal on line 204 is effective to cause circuit 192 to drop one clock pulse during every other count-down cycle of note divider 136, the effect of this being to produce an output pulse train which, when filtered, is at the desired note frequency.

A chorus generator 206 is also provided which, when enabled, produces a signal on line 208 which causes a selected number of clock pulses to be dropped at periodic intervals by circuit 192, the number depending on the octave and half octave code appearing on the lines **38*f***. This results in a variation in the output frequency at a uniform beat rate, regardless of note frequency, producing a chorus effect.

A special function control circuit 210 is responsive to the special function control input 32 (see FIGS. 1 and 2), and provides signals over line 212 to clock rate control circuit 192, causing clock pulses to be dropped in accordance with predetermined criteria to achieve certain desired special effects. As was previously indicated, by periodically increasing and decreasing the number of clock pulses which are dropped at a relatively low frequency, a vibrato effect is achieved. By steadily increasing or decreasing the number of pulses which are dropped, a glide effect may be achieved; and by holding the number of pulses added at a constant level, a chorus effect is obtained.

Finally, each note generator 24M or S includes a pulse code generator circuit 214, to which high frequency clocks on line 28 are applied, as well as the octave and half octave code bits of lines **38*f*. Circuit 214 divides down the clock pulses applied thereto in accordance with the code on lines 132 to produce a bit-serial width-modulated pulse code on line 38*b*, the duty cycle of which varies as a function of the octave and half octave code. The width-modulated pulse code may be used, as an alternative to the bit-parallel code appearing on lines 38*f*, for conveying octave and half octave information to the keyer circuits 40**, and various other circuits, in order to program them according to the note selected. For a fuller disclosure of the programming aspect of the instrument, the reader may refer to the above-mentioned copending application of Glenn Gross.

Figure 5:
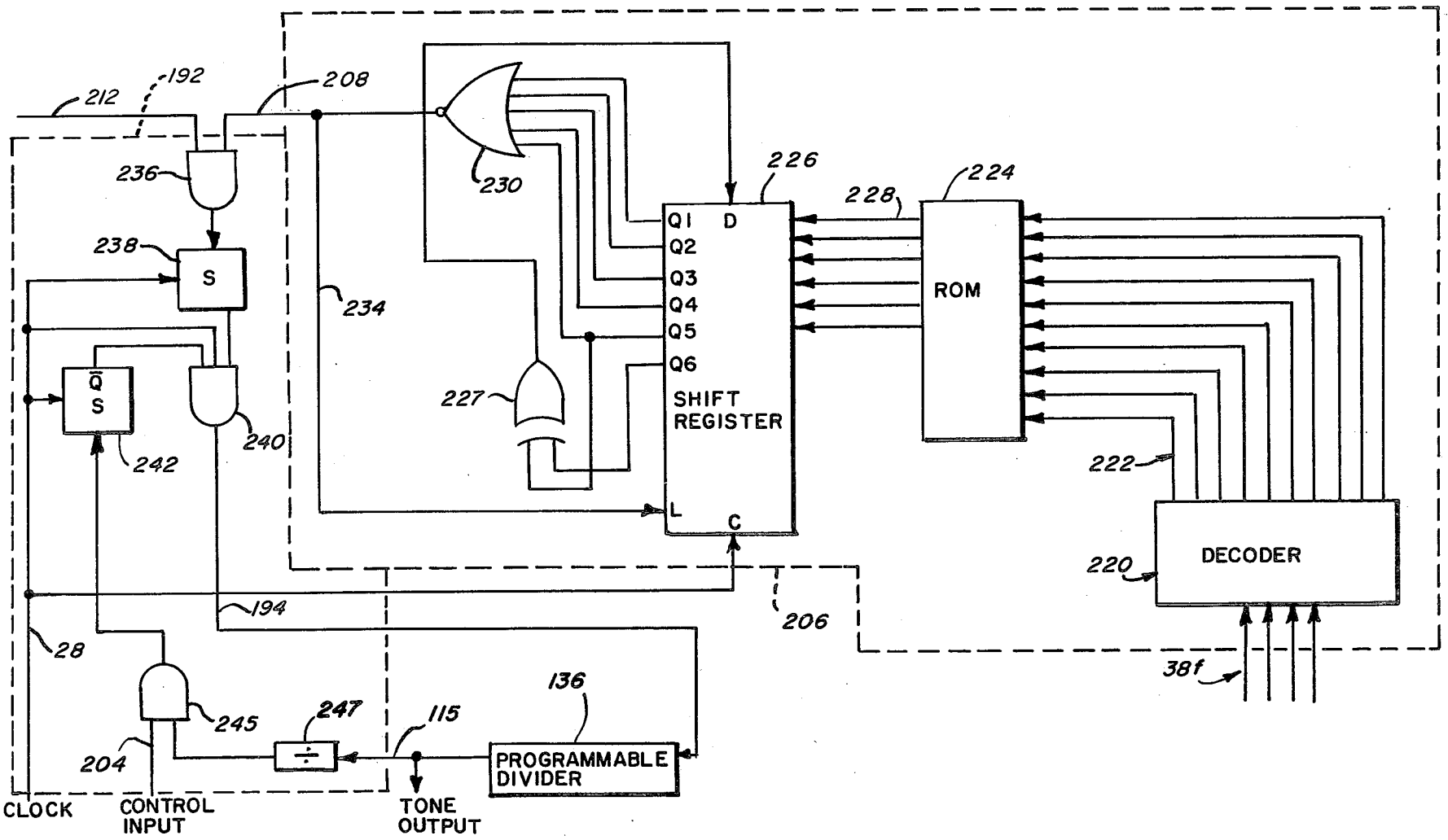
FIG. 5 is a logic and functional block diagram of the chorus generator of FIG. 3.

FIG. 5 illustrates in greater detail the circuitry of the clock rate control 192 and the chorus generator 206. The four lines of bit-parallel code **38*f* coming from the code conversion ROM 202 are applied to a decoder 220**. The decoder determines from the four bits of input information which octave and half octave the selected musical note falls in, and, accordingly, decodes to an appropriate one of the output lines 222. The selected one of the lines 222 instructs a read-only memory (ROM) 224 to load a corresponding digital word into a six-stage shift register 226. The digital word is applied to the shift register in bit-parallel code form over lines 228. The loading of the shift register 226 in this fashion is equivalent to presetting it to some numerical value. After the numerical value is pre-set, the clock pulses on line 28 (see FIG. 3) are applied to the clock input C of the shift register 226, causing the shift register to count through its remaining binary digital states. The number of states is increased, however, by means of an exclusive OR gate 227 which feeds back two of the stages to a special load input D. Eventually even the larger number of states provided by the gate 227 is counted through, whereupon a condition is reached in which the first five states of the shift register Q1–Q5 are all at zero. This condition is detected by a NOR gate 230 which then puts an output upon line 234 leading back to the load input L of the shift register 226. As a result, the number available on the lines 228 is reloaded into the shift register 226, and the cycle repeats itself.

Each time such a cycle is completed, the output of the gate 230 appears also upon a line 208 leading to an AND gate 236 which, when enabled, drives a synchronizer circuit 238. The output of the synchronizer goes to another AND gate 240 which, when enabled, drives the output of line 194 which provides the modified train of clock pulses leading to the programmable divider 136 seen in FIG. 3.

The other inputs to the AND gate 240 are the stream of clock pulses on line 28 (see FIG. 3), and a second synchronizer circuit 242. The stream of clock pulses is also applied to regulate both synchronizer circuits 238 and 242.

Strictly speaking, a chorus effect is produces by a small, periodically varied phase shift introduces into a musical note, the phase-shifted note being beat against the same note produced simultaneously but without any phase shift. In this instrument, however, a type of pseudo-chorus effect is achieved by introducing, instead of a true phase shift, a small frequency shift, which is constant in amount rather than periodically varied.

The operation of FIG. 5 is such that every time the shift register 226 is recycled, an extra pulse on line 208 is slipped into the stream of clock pulses which arrives on line 28 and emerges on line 194 leading to the programmable divider 136 of FIG. 3, provided that a signal is applied to line 212 coming from the special function control circuit 210 (FIG. 3), and serves to enable the gate 236 of clock rate control circuit 192.

Figure 6:
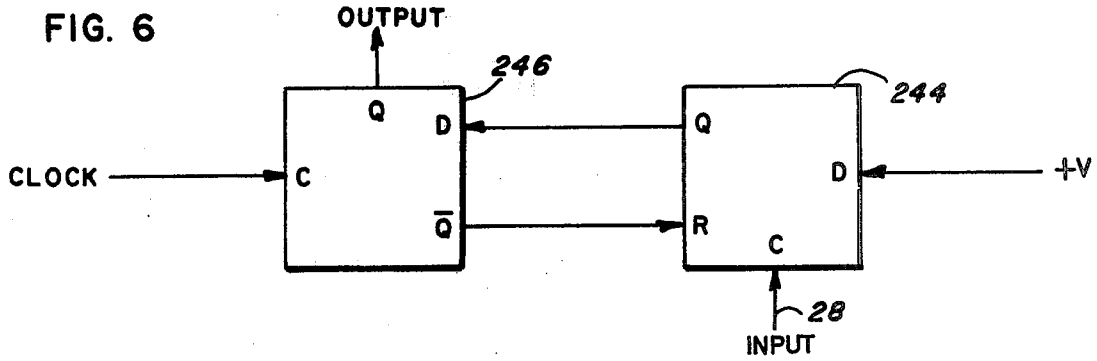
FIG. 6 is a functional block diagram of a synchronizer used in the circuits of FIGS. 5, 8 and 9.

The synchronizer circuits 238 and 242 are regulated by the clock pulses 28 and serve to synchronize the application of pulses to gates 236 and 240 with the clock pulse stream on line 28. The details of the synchronizer circuits are seen in FIG. 6. Each synchronizer 238 or 240 comprises a first D-type flip-flop 244 and a second D-type flip-flop 246. The clock pulse stream on line 28 is applied to the C (clock) input of the first flip-flop 244, and the input, which is to be synchronized with the clock pulses, is applied to the C (clock) input of the second flip-flop 246. In the case of the first synchronizer 238 in FIG. 5, this input comes from the gate 236; whereas in the case of the second synchronizer 242 of FIG. 5, this input arrives on the line 204 coming from the pitch control ROM 134 (FIG. 3). The Q output of the first flip-flop 244 drives the D input of the second flip-flop 246, while the Q output of the second flip-flop 246 drives the R (reset) input of the first flip-flop 244. The D input of the first flip-flop 244 is connected to a constant source of positive voltage. The operating characteristic of the two flip-flops 244 and 246 is such that every time a pulse is applied to the C input of one flip-flop, the Q output of that flip-flop takes the state of the concurrent D input to that flip-flop, and, of course, its $\overline{Q}$ output takes the opposite state. Since the D input of the first flip-flop 244 is always a 1-state, every time an input is applied to the C terminal of that flip-flop, a 1-state Q output from flip-flop 244 is applied to the D input of the second flip-flop 246. Accordingly, the next time that a clock hits the C input of the second flip-flop 246, a 1-state output synchronized with the clock stream will appear at the Q output of the second flip-flop.

Returning once again to FIG. 5, in the case of the first synchronizer circuit 238, every signal from the gate 236 is converted into an output having an edge which is synchronized with the clock pulse stream on line 28, and applied to the gate 240. The synchronizer circuit 242 is controlled by the signal on line 204 which is one of the bits on cable 135 (FIG. 3) applied by pitch control ROM 134 to convey pitch control information to the programmable divider 136. The divider 136 performs the function of dividing down the high frequency clock pulse on lines 28 and 194 (FIGS. 3 and 5) to produce the music tone called for by the ROM 134. Whenever there is no bit on line 204, that means the circuit is not at that moment calling for the performance of a non-integral frequency division operation. The absence of a bit on line 204 disables an AND gate 245 so that no gate output appears, and the synchronizer 242 remains at rest; i.e. its Q output remains continuously high. Therefore the gate 240 is continuously enabled, and no pulses are deleted from the pulse stream which gate 240 passes to the programmable divider 136. But during the entire time that a bit appears on line 204, the circuit continuously performs a non-integral frequency division operation. During that time the gate 245 is continuously enabled, and pulses from a frequency divider 247 pass through the gate 245, each one activating the synchronizer 242 once. Each time the synchronizer 242 is activated, its Q output is momentarily lowered, which disables gate 240 long enough to delete just one clock from the pulse stream issuing on line 194. The deletion of this clock lengthens by one clock time the interval required for divider 136 to count down, and thus reduces the resulting musical tone frequency output on line 115 which is fed to the octave divider 138 and pitch divider 200 (FIG. 3). The exact value of the resulting reduction in frequency (the frequency division ratio) depends on the frequency division ratios chosen for the circuit 247 (which is fixed), and the circuit 136 (which is programmed by the pitch control ROM 134 of FIG. 3). But the point to be specially noted here is that, for some values of the frequency division ratios of the circuits 247 and 136, the frequency division ratio resulting from the action of the gate 240 is a non-integral value, such as two thirds, despite the fact that each of the circuits 247 and 136 are frequency dividers of the conventional counter type which, operating separately, are only able to produce respective integral frequency division ratios. This represents an economical way to achieve non-integral frequency division; as compared to the standard approach of using only integral frequency division, which necessarily requires a higher frequency, and, therefore, more costly, clock.

The line 212 which enables gate 236 in FIG. 5 is the output line from the special function control circuit 210 of FIG. 3. This circuit is seen in greater detail in FIG. 7. Line 212 comes from one end of a resistor 250, and the other end of the resistor is connected to a source of positive voltage. Therefore, an enabling voltage for gate 236 of circuit 192 (FIG. 5) is developed on the line 212 whenever a circuit can be completed from the source of positive voltage through the resistor 250 and an OR gate 252 to ground. Thus, by closing a switch 254 manually, the operator of the musical instrument places a continuous enabling voltage upon line 212 so that the gate 236 of the circuit 192 in FIG. 5 is enabled, preparing the circuit 192 to receive the chorus pulse stream on line 208 from the chorus generator circuit 206.

Figure 7:
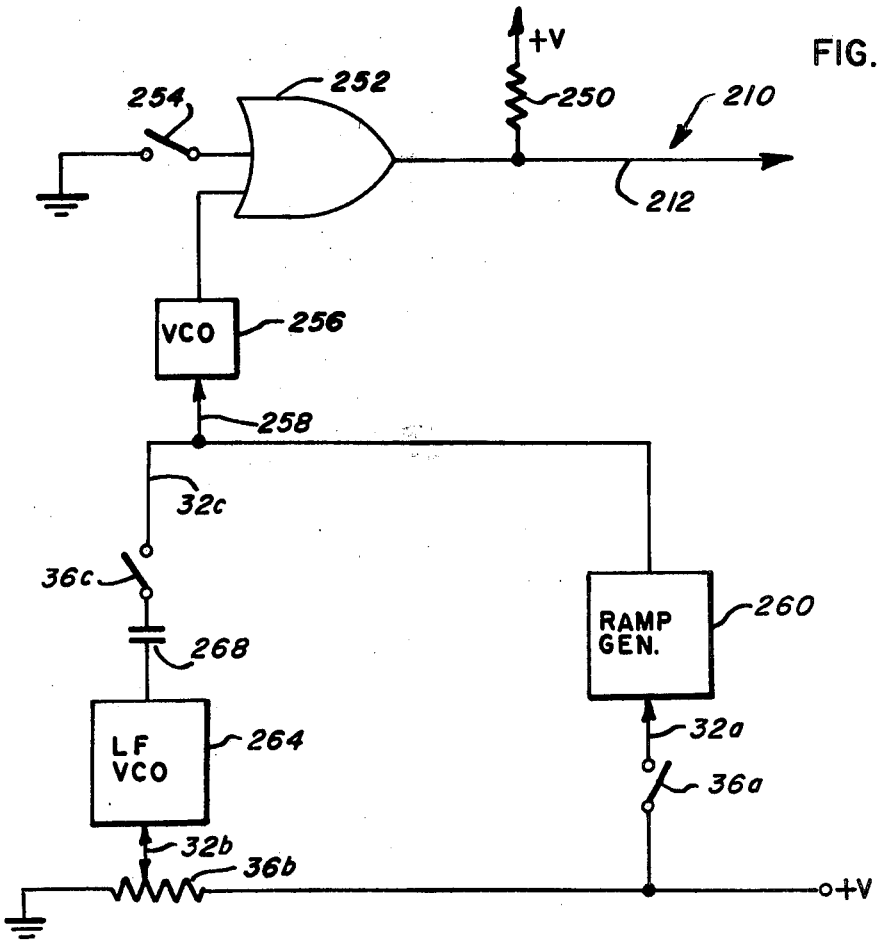
FIG. 7 is a functional block diagram of the special function control circuit of FIG. 3.

Looking again at FIG. 7, it is seen that there is a second input to the OR gate 252 which is also capable of placing a gate-enabling voltage on line 212. A voltage-controlled oscillator 256, which is a free-running multivibrator producing a rectangular wave output at a frequency determined by the voltage level on an input line 258, provides a stream of pulses which intermittently drive the gate 252 and thus intermittently activate the clock rate control circuit 192 of FIG. 5. The operating frequency of the multivibrator 256 determines the duty cycle of the clock rate control cicuit 192, and thus determines the number of extra pulses per unit time which the circuit 206 is permitted to insert into the pulse stream output appearing on line 192. In order to control the frequency of the oscillator or multivibrator 256, the voltage on its frequency control input line 258 may be varied in either one of two ways.

First, in order to achieve an unidirectional pitch glide effect, a ramp generator 260 is turned on by means of a manual switch 36*a*, and applies a slowing and steadily rising or falling voltage to the oscillator 256 over the line 258. If the output voltage ramp is ascending, then the operating frequency of the oscillator 256 increases during the cycle time of the ramp generator 260. Consequently, the gate 252 is enabled at a steadily increasing repetition rate, and the result is that a steadily increasing number of extra pulses is inserted by the circuit 192 into the pulse stream appearing on the output line 194 of FIG. 5. Conversely, if the ramp output of circuit 260 is descending, the oscillator 256 operates at a steadily decreasing frequency, and the number of pulses inserted decreases over time. The result in the first instance is a rising pitch slide, and in the second instance, a descending pitch slide.

The other source of frequency control voltage for the oscillator 256 is a low frequency voltage-controlled oscillator 264. By low frequency, it is meant that the operating frequency of oscillator 264 is substantially lower than that of oscillator 256. The frequency of oscillator 264, moreover, is variable manually by means of a potentiometer 36*b*. The oscillator 264 provides an output through a capacitor 268 and a manual switch 36*c* to the frequency control line 258 of oscillator 256. When the manual switch 36*c* is closed, the voltage on line 258 rises and falls with the output of the low frequency oscillator 264. Since the voltage on line 258 controls the operating frequency of the high frequency oscillator 256, the operating frequency of the latter rises and falls in the same manner. Thus, the oscillator 256 is frequency-modulated at the frequency of the low frequency oscillator 264. As the frequency of the high frequency oscillator rises and falls, the repetition rate at which gate 236 and hence the circuit 192 of FIG. 5 is activated, rises and falls also. This, in turn, means that the number of extra pulses inserted by the circuit 192 into the output pulse stream on line 194 rises and falls. The result is that the musical pitch of the selected note varies up and down which is heard as a vibrato effect. The rate at which the vibrato effect oscillates back and forth is controlled by the rate of frequency modulation of the oscillator 256, which in turn is governed by the frequency of oscillator 264, and that in turn may be manually adjusted by means of the potentiometer 36*b*.

The manual controls 36*a*, *b* and *c* of FIG. 7 are some of the control switches represented by functional block 36 in FIG. 1; and their connecting leads 32*a*, *b* and *c* seen in FIG. 7 correspond to control inputs 32 of FIGS. 1 through 3.

Figure 8:
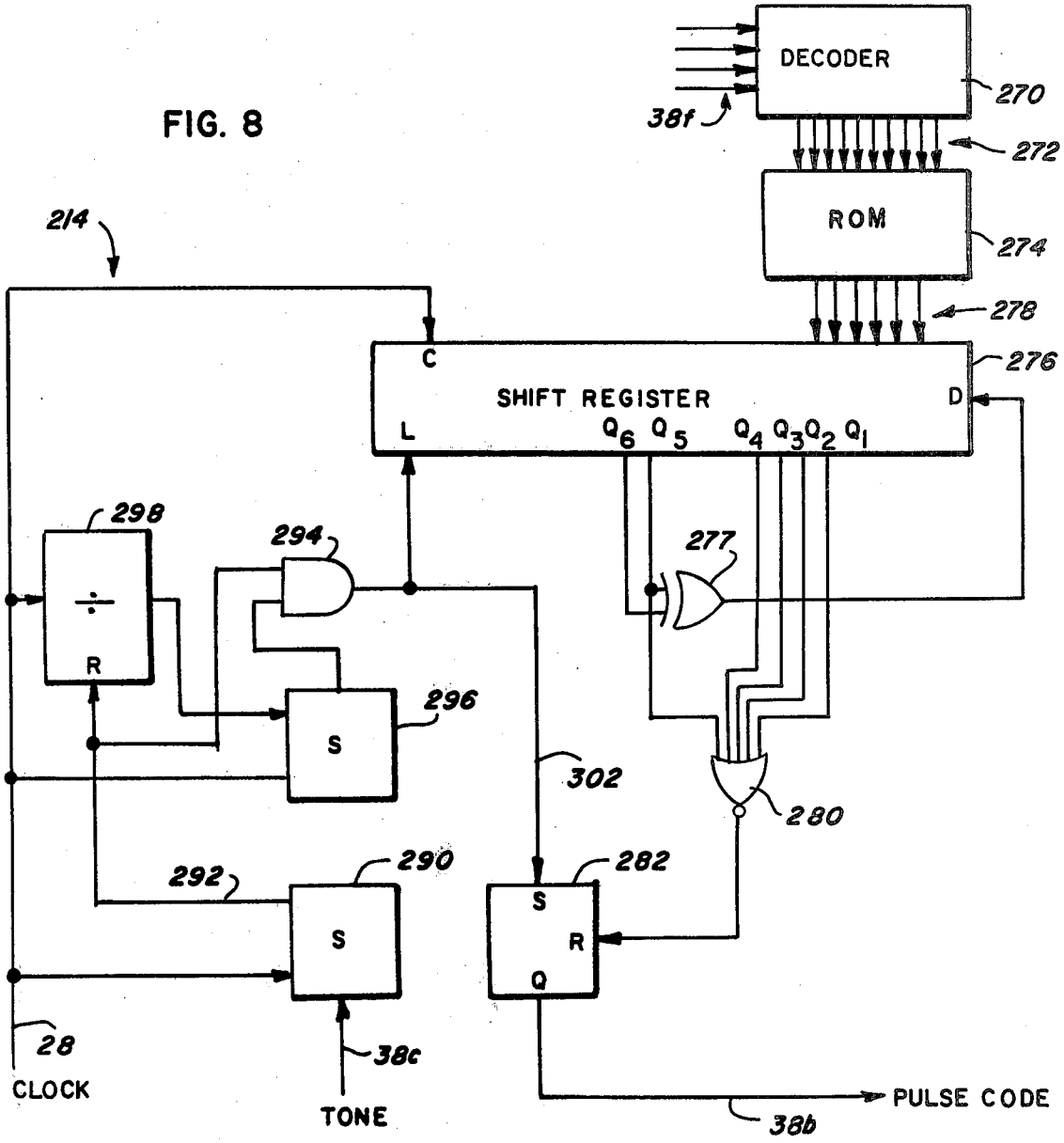
FIG. 8 is a functional block diagram of the pulse code generator of FIG. 3.

FIG. 8 illustrates in greater detail the pulse code generator 214 which produces a width-modulated pulse code on line 38B which may in some instances be used as an alternative to the bit-parallel code on output lines 38*f* (FIG. 3) to provide octave and half octave information to programmable circuits which are responsive to any one of the priority note generators 24 or 26, such as, for example, the keyers 40 or the voicing circuits 54 of FIG. 1. As previously noted, the detailed nature of these circuits, and the manner in which they are programmed by means of the codes on lines 38*f* or on line 38*b*, is more fully explaind in the above-mentioned copending application of Mr. Gross.

In FIG. 8, it is seen that the musical tone signal produced by the priority note generator on line 38*c* is applied to a synchronizer 290, identical to that described in connection with FIG. 7. This synchronizer is regulated by the clock pulse stream arriving on line 28 so that the output of the synchronizer on line 292 is synchronized with the clock. The clock-synchronized tone signal output on line 292 is then applied as one input to an AND gate 294. The other input to the AND gate 294 comes from the output of another such synchronizer 296 which is regulated by the stream of clock pulses on line 28 to achieve clock synchronization of the Q output of a frequency divider 298. The circuit 298 divides down the clock pulses on line 28, after which its output is available through the synchronizer 296 to enable the gate 294. When a pulse passes through the gate 294, it applies a load pulse to the load input L of a shift register 276. When this happens, whatever binary digital numerical value happens to be available on input lines 278 is loaded into the shift register 276. At the same time, gate 294 also drives the set input S of code generator flip-flop 282 setting it. This determines the initial state of the code generator flip-flop 282.

Four bits of octave and half octave information available from the code conversion ROM 202 (FIG. 3) on lines 38*f* are applied to a decoder 270 which decodes the octave and half octave information to single one of its output lines 272 leading to a read-only memory (ROM) 274. The ROM responds to the information received from the decoder 270 by presenting a specific binary digital code word to the shift register 276 over lines 278. It is this word which is loaded into the shift register when the input is strobed by gate 294. After the shift register 276 is thus set to an initial numerical state, it proceeds to count through the balance of its numerical states in response to a clock input arriving over line 28 (see FIG. 3) and applied to the clock input terminal C of the shift register 276. Once again, the modulus of the counter is increased by feedback from an exclusive OR gate 277 to a special load terminal D. When the count has progressed to the point that five of the shift register stages Q1–Q5 are all equal to zero, this condition is detected by a NOR gate 280 which then resets the code-generating flip-flop 282. Thus, the "on" time of the flip-flop 282 is limited by the numerical value of the amount initially loaded into the shift register 276.

For a larger numerical value, the "on" time of the flip-flop 282 is terminated sooner, and thus the pulse width of its Q output is shorter. For a lower numerical value, it takes a longer time for the shift register to count through to the end of its cycle, and, therefore, the "on" time of flip-flop 282 is longer, and the Q output from the flip-flop stays high a longer period of time during each count cycle of the shift register 276. The pulse code output line 38*b* is taken from the Q output of the flip-flop 282, so that the width of the pulses on that line is a function of the numerical value loaded into the shift register 276.

SOLO HIGH NOTE GENERATOR

Figure 9:
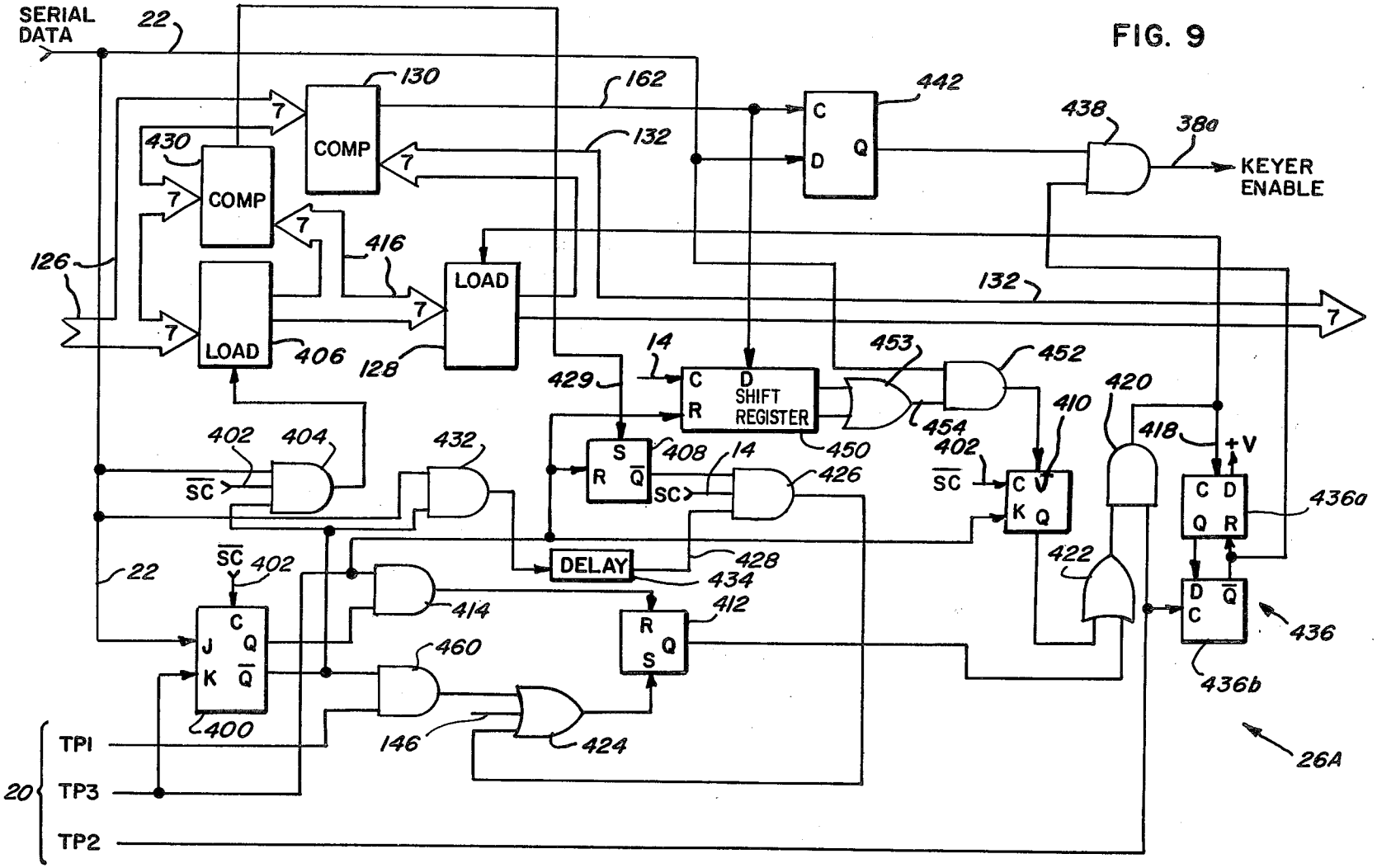
FIG. 9 is a logic and functional block diagram of a portion of a solo high note generator.

In FIG. 3, a dotted box 216 has been placed around the logic elements which are specifically required for priority note assignment. FIG. 9 shows the elements which would be substituted in box 216 to convert the priority note generator 24 of FIG. 3 to a solo-high note generator 26A. The circuitry of FIG. 3 outside of box 216 is the same for both the priority note generator 24 and the solo generator 26.

Referring now to FIG. 9, timing pulse TP3 initializes certain logic conditions at the start of each cycle of the scan clock 26 (FIG. 1). It strobes the K input of a JK flip-flop 400, while the scan clock 16 puts out a pulse stream which is inverted and applied to the clock input C of flip-flop 400 over a line 402. As a result, the $\overline{Q}$ output of the flip-flop is initially in a 1-state, which partially enables a serial data AND gate 404. Gate 404 is later fully enabled when the next inverted scan clock pulse on line 402 arrives. The TP3 pulse also initializes a set-reset flip-flop 408, and a JK flip-flop 410. The flip-flop 408 is reset by the TP3 pulse directly, thus putting its $\overline{Q}$ output in a 1-state. The K input of the flip-flop 410 is strobed by the TP3 pulse while a coincident inverted scan clock pulse on line 402 arrives at the C (clock) input, thus setting the Q output to a 1-state.

The first operation to be described, after initialization, is the loading of a seven-bit solo note latch 406. Bear in mind that the flip-flop 400 is initially in a $\overline{Q}=1$ state, so that serial data gate 404 is partially enabled. It should also be pointed out that each serial data pulse lasts twice as long as each scan clock pulse. Accordingly, if there is a coincident serial data pulse on line 22 (see FIG. 1), indicating that the presently scanned key of the musical keyboard is now depressed, the serial data pulse passes through serial data gate 404 and loads a 7-bit solo note latch 406 with the information presented on lines 126. The latter, as explained in connection with FIG. 3, consists of seven bits of present note and octave information taken from the running count of note and octave scan counters 120 and 122. Thus, an indication of the note and octave represented by this particular depressed key is entered into storage in solo note latch 406.

The keys of the instrument are scanned in decreasing order of pitch, i.e. from high notes to low. Thus, the first depressed key encountered during any scan represents the highest pitch note then being played. Since the serial data gate 404 is enabled by the first serial data pulse after the TP3 pulse which occurs at the start of each scan cycle, it follows that the information entered into solo note latch 406 always represents the highest note presently being played at the time the latch 406 is loaded. Hence, tone generator 26A is designated the solo "high" generator.

The serial data pulse from the highest key presently being played, which loads the latch 406, also strobes the J input of flip-flop 400. That, plus the coinciding inverted scan clock pulse applied over line 402 to the clock (C) input of flip-flop 400, resets that flip-flop to Q32 1, and thus disables the serial data gate 404 to prevent any further change in the state of latch 406, if any lower pitch keys are found to be depressed when those keys are scanned later on in the high-to-low scan cycle. The serial data gate 404 will not thereafter be re-enabled until the start of the next scan cycle, at which time the contents of the solo high latch will be changed only if the highest key played has changed since the previous scan.

As described above, the first scan cycle after a highest note is selected is effective to load the code for that note into the solo note latch 406. Then on the next scan cycle, as will now be described, that same note code may be loaded into the previously described assigned note and octave code storage latch 128, the output of which, on lines 132, is effective to determine which note the generator 26A generates (for the reasons explained above, during the discussion of generator 24 in connection with FIG. 3). The solo note latch 406 makes its contents available to the assigned note and octave latch 128 over lines 416. The loading of latch 128 with a copy of the contents of latch 406 takes place when a load signal arrives over a line 418 from an AND gate 420. The latter passes a timing pulse TP2 to accomplish the loading operation whenever it is enabled by an OR gate 422. One way for that to happen is by setting a flip-flop 412. The flip-flop is initially set by a TP1 timing pulse passing through an AND gate 460 and/or gate 424 when the AND gate is enabled by the $\overline{Q}=1$ output from flip-flop 400 (its initial condition). The flip-flop 412 is also initially set at power turn-on time by a power-on signal on line 146 (see FIG. 3). As a result, the conditions for loading the assigned note and octave latch are satisfied at the beginning of each scan cycle.

But after the first (i.e. solo high) serial data pulse on line 22 hits the J input of flip-flop 400, switching it to the Q=1 state, and AND gate 414 is enabled, so that the next TP3 timing pulse which comes through the gate resets flip-flop 412. So long as that flip-flop remains reset, gate 420 is deprived of its enabling input, which prevents any further loading of the assigned note latch 128 for the remainder of the scan cycle, unless a subsequent set input is supplied to flip-flop 412 by gates 426 and 424. This happens whenever a serial date pulse on line 22 passing through an AND gate 432 and a delay circuit 434 to produce a bit on a line 428, coinciding with a scan clock on line 14 (see FIG. 3), finds gate 426 enabled by a Q=1 output from flip-flop 408 (that being its initial condition due to the reset input from timing pulse TP3, as described above). The serial data pulse on line 22, if it is the first serial data in a scan cycle, i.e. the solo high note pulse, will find gate 432 enabled due to the Q=1 initial condition of flip-flop 400, which continues up to and including that first serial data pulse. Therefore, the first serial data pulse transits the gate 432 and drives the delay circuit 434 to produce the required output on line 428. This means that, unless something happens first to set flop-flop 408, as will be described later, the normal result of every TP2 pulse and solo high serial data pulse in every scan cycle will be to load the assigned note and octave latch 128, thus for the moment assigning the solo high tone generator 26A to the production of that note in the octave.

The output of gate 420, appearing on line 418, in addition to loading the assigned note latch 128, also drives a synchronizer 436 which enables a keyer AND gate 438, the output of which is the keyer enabling signal on line 38*a* (see FIGS. 1, 2 and 3). The synchronizer 436 is identical to that illustrated in FIG. 6, and comprises a first flip-flop 436*a* and a second flip-flop 436*b*, corresponding to the flip-flops 244 and 246 respectively of FIG. 6. As a result, the signal on line 418 is synchronized with timing pulse TP2, producing a pulse output on a line leading to the keyer gate 438.

A level signal, which comes through the gate 438 to enable the keyer 40 associated with the solo high generator 26A (see FIGS. 1 and 2), comes from the Q output of a keyer enable flip-flop 442. The latter receives a D input from every serial data pulse on line 22, i.e. every time a depressed key is detected during every scan cycle. Each such serial data pulse attempts to set Q=1 at the flip-flop 442, but this effort succeeds only when one of the serial data (key closure detection) pulses coincides with an equal comparison output on line 162 from the comparator 130, which (as previously described in connection with FIG. 3) compares the running note and octave count on lines 126 to the assigned note and octave code stored in latch 128. The coincidence of signals on lines 22 and 162 means that the key for the solo high note now assigned to generator 26A (the one which was stored in the assigned note latch 128 on some previous scan cycle) is still depressed on the present scan cycle, and therefore it is appropriate to set a Q=1 condition into flip-flop 442, which provides the keyer enable signal on output line 38*a* of keyer gate 438.

The synchronizer 436 is switched at the beginning of every scan cycle by the TP2 pulse, and then later switched back again in each cycle by the pulse on line 418 which represents the detection of a solo high key depression, either a new solo high key or a continuation of the old one. As a result, percussive envelope generator circuits, which need to be triggered by a sharp edge rather than simply a continuation of the Q level from flip-flop 442, are satisfied even if the present solo high key is not a new one, but is merely a continuation of a key depression detected in a previous scan cycle. For a discussion of a percussive envelope generator and why it requires an edge from the generator 26A to trigger it, refer to the aforementioned Gross application.

When a chord is played, and thereafter the top note of the chord is released, while other chord notes lower in pitch than the top note are sustained, it is musically undesirable for the highest remaining note of the chord to be treated as a new, lower pitch replacement for the released solo high note. This is because the lower note is part of the harmony, not the melody, and therefore should not receive whatever special voicing treatment is applied to emphasize the solo high note. Instead (with one exception mentioned later), the solo high note stored in latch 128 should be temporarily ignored by the instrument whenever the highest key actuated is succeeded by a new highest key of lower pitch, and that lower pich key has been continuously depressed since a time prior to the release of the higher pitch key.

The logic for canceling the solo high note designation under these circumstances will now be described. At the beginning of each scan cycle a TP2 pulse switches the synchronizer 436, thus disabling the keyer enable gate 438 by depriving it of the $\overline{Q}$ output of flip-flop 436*b*. Thus, it is necessary to re-enable gate 438 all over again once each cycle, in the manner described above, if the associated keyer 40 (FIG. 1) is to respond to the solo high tone generator 26A. If the keyer does not respond, no solo note high note is sounded, even though the solo high generator 26A is still making available to the keyer 40 a tone determined by the note and octave code stored in the latch 128.

The re-enablement of keyer gate 438 will occur each scan cycle by operation of gates 420 and 422, flip-flop 412, gates 424 and 426 in the manner described above, but only if flip-flop 408 still remains in its initial $\overline{Q}=1$ condition at the time of the pulse on line 428. The entire operation will be aborted if, prior to the arrival of the pulse on line 438, the flip-flop 408 has been set by a signal on a line 429 representing a comparison output from a seven-bit comparator 430. The signal on line 429 occurs when comparator 430 senses equality between the seven-bit code word (the running note and octave count from counters 120 and 122, FIG. 3) on lines 126, and the previous cycle's solo high code word still stored in latch 406, and presented to comparator 430 on lines 416. When this comparison is detected, it means the present scan cycle has progressed down in pitch as far as the solo high note of the previous scan cycle. If the solo high note (highest key actuated) detected in the present scan cycle is higher in pitch than the note, the code for which is stored in latch 406, then the solo high (i.e. first) serial data pulse on line 22 for the present cycle will occur before the comparison output on line 429 can disable the gate 426 by the setting of flip-flop 408, and therefore the pulse on line 428 will pass the gate 426. But if a new solo high note is detected in the present scan cycle, which is lower in pitch than the old solo high note of the previous scan cycle, the code for which is still stored in latch 406, then the old solo high note code will be equaled on counter lines 126 before the new serial data pulse on line 22 occurs, and as a result the comparison pulse on line 429 will set the flip-flop 408 and disable gate 426 before the new solo note data pulse, delayed by circuit 434, arrives on line 428. Therefore, the keyer gate 438 will not be re-enabled in that scan cycle.

Even though the lower note which is detected does not re-enable the scan cycle, the code for that note is loaded into latch 406. Therefore, on the next scan cycle, assuming this is still the highest note detected, the signal on line 409 will occur at the same time a data pulse appears on line 22. However, the application of this pulse to enable gate 426 is delayed sufficiently by delay 434 so that flip-flop 408 is set by the signal on line 429, disabling gate 426, before the data pulse is applied thereto. Therefore, the note code is not loaded into latch 128 and keyer gate 438 remains disabled.

There is one exception to the rule of ignoring a new solo high note of lower pitch than its predecessor. If the new lower solo high note is within two notes of its predecessor, then it is likely that the two notes do not form part of a chord at all, but instead are part of a downward arpeggio. In an arpeggio, unlike a chord, every note is a melody note, and should receive solo high treatment.

Here we are using the term chord to mean notes played substantially concurrently, and the term arpeggio to mean notes which are played substantially sequentially. If the notes of an arpeggio did not overlap each other in time at all, the logic circuitry so far described would have no difficulty in distinguishing a chord from an arpeggio, and it would lock out the new lower pitch solo high note only in the chord situation, not in the arpeggio situation. But as a practical matter, it is not at all uncommon for the player to depress the next key of an arpeggio an instant before the preceding key is released. To the human ear, the resulting overlap may be so slight as to go unnoticed, but even this brief overlap will fool the instrument into thinking that a chord is being played. To prevent this, a two-bit shift register 450 cooperates with an OR gate 453, AND gate 452 and the flip-flop 410, comprising a two-note window circuit which provides an alternate route of entry to the OR gate 422 for enabling AND gate 420 to load the assigned note latch 128 and enable the keyer gate 438 via synchronizer 436.

The shift register 450 is reset to all zeros at the beginning of each scan cycle by a TP3 pulse to its R reset input. The D input of the shift register 450 takes its data from the comparison output on line 162 from comparator 130. The latter, as previously described, indicates that the present scan cycle has progressed down to the assigned note and octave, the code for which was stored in the latch 128 in a previous scan cycle. Both stages of the shift register are clocked by a C input comprising scan clocks on line 14 (see FIG. 1). The comparison input on line 162 is clocked in by the first subsequent scan clock pulse on line 14, thus setting the first shift register stage to a 1-state. The second subsequent scan clock pulse on line 14 resets the first stage to zero, and advances the 1-state through to the second stage of the shift register. The third subsequent scan clock pulse resets the second stage to zero, so that no further 1-state outputs are available from either stage after two scan clock times have expired. The outputs of both stages are OR-ed together by gate 453, the output of which appears on a line 454. This output line 454 enables the gate 452, and FIG. 10 shows that it does so for exactly two consecutive scan clock cycles; i.e. the first scan clock cycle causes the first shift register stage to enable the gate, the next scan clock cycle causes the second shift register stage to do so, and thereafter the gate is disabled. FIG. 10A shows several consecutive scan clock cycles, and FIG. 10B shows the output of the OR gate 453 on line 454 spanning two of those cycles. After the scan proceeds downward in pitch from the previous solo high note, if the next lower key found to be depressed is within two notes of the previous solo high note, then the serial data pulse on line 22 corresponding to the next lower key depression will occur within two scan clock times of the comparison output on line 162. Consequently, that serial data pulse on line 22 will reach gate 452 during the two-note time window when the latter is enabled, and will pass through the gate to the J input of flip-flop 410.

Flip-flop 410, it will be recalled, is initially placed in a Q=0 condition by the TP3 pulse coming to its K input. The two-note window signal from gate 452, however, drives the J input, and, therefore, the next inverted scan clock pulse on line 402 switches it to Q=1, and that Q output then passes through gate 422 to do the job of enabling gate 420, a job done under other circumstances by flip-flop 412. The output of the gate 420 then proceeds to load the assigned note latch 128 and to drive the synchronizer 436 to enable the keyer gate 438 as described previously.

SOLO LOW NOTE GENERATOR

If the circuitry included within the dashed line 216 of FIG. 3 is replaced by that illustrated in FIG. 11, the tone generator becomes the solo low generator 26B of FIG. 2. The circuit of FIG. 11 is similar to that of the solo high generator in FIG. 9, although less complicated, and similar reference numerals will be used to emphasize the resemblance. The solo note latch 406 receives a running count of the note and octave scan over lines 126 from the note counter 120 and octave counter 122 of FIG. 3, and the present value of the note and octave count is loaded into the latch 406 each time a serial data pulse on line 22 (indicating an actuated key) hits the latch load input. Thus, if more than one key is down, the code for each depressed key is entered into solo latch 406 in succession in the course of each scan cycle. The last such code to be entered into the latch in each cycle represents the lowest note played, because the scan direction progresses downward in pitch. Thus, a TP4 timing pulse, which always occurs at the end of each scan cycle, is effective to load into the assigned note and octave latch 128 only that code from solo latch 406 which corresponds to the lowest pitch key that is actuated at the time. The contents of assignment latch 128 is then presented on lines 132 to determine which note generator will produce, just as in the generators 24 described above in connection with FIG. 3.

The keyer activating signal on line **38*a* (see FIGS. 1 through 3) is derived from a keyer flip-flop 442 of the D type when it is set to its Q=1 state. That happens when a serial data pulse on line 22, indicating a depressed key detection, is presented to the D input of the flip-flop while the comparator 130 comparison output clocks the C input thereof. The comparator 130, which was discussed previously in connection with FIG. 3, produces its comparison output when the running scan count on lines 126 equals the contents of the assigned note latch 128 on lines 132, indicating that the key for the solo low (i.e. lowest played) note, the code for which was loaded into latch 128** on a previous cycle, is still depressed on the present cycle.

It will now be appreciated that the musical instrument of this invention not only provides tone generators which are programmable upon demand to produce any note within the musical range of the instrument, but also provides various special purpose tone generators of this type, some of which avoid phase cancellation between octavely related notes, and other of which make possible special voicing of the lowest and highest notes played. Each of the tone generators, furthermore, is equipped to produce various special effects, such as non-integral frequency division, chorus, vibrato, and pitch glide in connection with the tone being generated thereby. It should be noted that each of these features is believed to represent an inventive advance in the art of electronic musical instruments when considered alone, as well as when they are combined in the context of the entire instrument described herein. That instrument, moreover, is merely one example of the many ways in which these inventions can be realized in hardware form, and is not intended to limit the inventive concepts discussed herein, which may be employed in various other hardware configurations.

What is claimed as new and desired to be secured by letters patent of the United States is:

1. A tone generator system for a polyphonic electronic musical instrument, comprising note selection means, a plurality of primary programmable tone generators each assignable to play any of the notes within a selected musical range, said plurality being equal to a selected maximum number of notes within said range which may need to be played, said generators including priority assignment logic responsive to said note selection means and arranged to assign the selected notes to respective ones of said generators, said logic being further arranged to preclude the assignment of any note in any octave to more than one of said primary tone generators, and at least one special function programmable tone generator in addition to said primary generators, said special function generator having priority note assignment logic arranged to assign to it the same note in the same octave as is assigned to one of said primary generators whereby said note is singled out for special treatment.

2. A tone generator system for a polyphonic electronic musical instrument, comprising note selection means, a plurality of programmable master tone generators each assignable to play any of the notes within a selected musical range, said plurality being equal to a selected maximum number of notes within said range which may need to be played, said master generators including priority assignment logic responsive to said note selection means and arranged to assign the selected notes to respective ones of said master generators, said logic being further arranged to preclude the assignment of any note in any octave to more than one of said master generators, and at least one programmable slave tone generator having priority note assignment logic which is arranged to assign it to the same note in the same octave as is assigned to one of said master generators, said priority assignment logic being arranged to activate said slave generator to sound said note when and only when one of said master generators is sounding that same note in that same octave and another of said master generators is sounding that same note in another octave.

3. A tone generator system as in claim 1 wherein said special function generator is a solo generator and said priority assignment logic is arranged for said solo generator to sound the highest or lowest of the notes concurrently sounded by any of said primary generators.

4. A tone generator system for a polyphonic electronic musical instrument, the instrument having player-operated means for indicating the note or notes to be sounded, comprising:

a plurality of storage means, each adapted to store a coded representation of a single note to be sounded;

means responsive to an indication that a note is to be sounded for storing a coded representation of the note in a selected one of said storage means;

a source of high frequency clock signal;

a separate programmable frequency divider for each of said storage means, each of said dividers being adapted to receive the clock signal and to divide the frequency of said signal by a factor which is a function of the code stored in the corresponding storage means to produce an output signal at the frequency of the note having its code stored in said storage means;

means for detecting the storage of a note having a predetermined musical scale relationship to the other notes to be sounded;

and means responsive to said detecting means for storing a coded representation of the detected note in a particular one of said storage means.

5. A tone generator system as in claim 4 wherein said detecting means is adapted to detect the highest pitch note to be sounded.

6. A tone generator system as in claim 4 wherein said detecting means is adapted to detect the lowest pitch note to be sounded.

7. A tone generator system for a polyphonic electronic musical instrument having player-operated means for indicating the note or notes to be sounded, a plurality of storage means each adapted to store a representation of one of said selected notes, tone generator means responsive to said storage means for sounding tones corresponding to said selected notes, means responsive to said storage means for detecting the highest pitch note to be sounded, and additional tone generator means responsive to said detecting means for duplicating said highest pitch note, wherein the improvement comprises: means for comparing the present highest pitch note to be sounded with a former highest pitch note sounded, and means for preventing the duplication of said present note by said tone generator means if said present note is lower than said former note.

8. A tone generator system as in claim 7 wherein said preventing means comprises AND gate means, a flip-flop which may be switched in order to disable said gate means, and means conveying respective pulses to said gate means and said flip-flop in a time sequence such that, when and only when said present note is lower than said former note, said flip-flop is switched by the pulse directed to it and said gate means is thereby disabled before the pulse directed to it can pass through.

9. A tone generator system as in claim 8 further comprising note window means independent of said flip-flop for enabling said gate means for a selected time after said comparing means compares said present and former notes.

10. A tone generator system for a polyphonic electronic musical instrument comprising: means for selecting musical tones to be played, a high frequency source, a plurality of programmable frequency dividers responsive to said selecting means and each capable of dividing said high frequency from said source by any one of a plurality of divisors chosen as a function of musical tone selection for generating any tone within a selected musical range, at least one additional programmable frequency divider for dividing said same high frequency from said same source and responsive to said selecting means and arranged normally to redundantly generate only the highest or lowest of all the tones presently selected by said selecting means, and means for selecting the voicing of the tone generated by said additional frequency divider independently of the voicing of the tones generated by said plurality of frequency dividers.

11. An instrument as in claim 10 wherein there are two such additional generators, one of which normally generates the highest and the other of which normally generates the lowest of all the tones presently selected by said selecting means, and means for selecting the voicing of each of said additional generators independently of each other and of said plurality of generators.

12. A tone generator system for a polyphonic electronic musical instrument comprising: means for selecting musical tones to be played, a plurality of master tone generators responsive to said selecting means and each capable of generating any tone within a selected musical range, and a plurality of slave tone generators responsive to said master tone generators, whenever any two of said master tone generators are generating octavely related tones, to generate one of said octavely related tones concurrently with one of said master tone generators.

13. An instrument as in claim 12 wherein said tone generators comprise means for preventing any tone generator within said master group, and any tone generator within said slave group, from generating the identical tone as any other generator within its own group at the same time.

14. A tone generator system for a polyphonic electronic musical instrument, the instrument having player-operated means for indicating the note or notes to be sounded, comprising:

a plurality of storage means, each adapted to store a coded representation of a single note to be sounded;

means responsive to an indication that a note is to be sounded for storing a coded representation of the note in a selected one of said storage means;

a source of a high frequency clock signal;

a separate programmable frequency divider for each of said storage means, each of said dividers being adapted to receive the clock signal and to divide the frequency of said signal by a factor which is a function of the code stored in the corresponding storage means to produce an output signal at the frequency of the note having its code stored in said storage means;

the coded representation stored in each storage means including both note information and octave information;

and means responsive to said octave information for generating a pulse-width-modulated pulse code output, the pulse width of said output being a function of said octave information.

15. A tone generator system as in claim 14 wherein said means for generating a width-modulated pulse code output includes memory means storing a different value for each possible octave code, shift register means, means for loading the value from said memory means corresponding to the stored octave information into said shift register means and for causing a first change in the state of said pulse code output, means responsive to clock pulses from said source for varying the contents of said shift register means, and means responsive to the contents of said shift register means reaching a predetermined value for causing a second change in the state of the pulse code output.

16. A tone generator system for a polyphonic electronic musical instrument having player-operated means for indicating the note or notes to be sounded, comprising:

a plurality of storage means, each adapted to store a coded representation of a single note to be sounded;

means responsive to an indication that a note is to be sounded for storing a coded representation of the note in a selected one of said storage means;

a source of a high frequency clock signal;

a separate programmable frequency divider for each of said storage means, each of said dividers being adapted to receive the clock signal and to divide the frequency of said signal by a factor which is a function of the code stored in the corresponding storage means to produce an output signal at the frequency of the note having its code stored in said storage means, and means for selectively causing pulses to be added to or dropped from the pulses coming from said high frequency clock signal source and applied to at least selected ones of said programmable dividers only during alternate cycles of said programmable divider whereby the number of division ratios available in said programmable divider is effectively increased.

17. A tone generator system for a polyphonic electronic musical instrument having player-operated means for indicating the note or notes to be sounded, comprising:

a plurality of storage means, each adapted to store a coded representation of a single note to be sounded;

means responsive to an indication that a note is to be sounded for storing a coded representation of the note, including both note and octave or fractional octave information in a selected one of said storage means;

a source of a high frequency clock signal;

a separate programmable frequency divider for each of said storage means, each of said dividers being adapted to receive the same undivided clock signal and to divide the frequency of said signal by a factor which is a function of the code stored in the corresponding storage means to produce an output signal at the frequency of the note having its code stored in said storage means;

and means for selectively causing pulses to be added to or dropped from the pulses coming from said high frequency clock signal source and applied to at least selected ones of said programmable dividers, including means responsive to the octave or fractional octave information in the corresponding storage means for modifying the rate at which clock pulses will be added or dropped as a function of the octave or fraction of an octave in which said note occurs.

18. A tone generator system as in claim 17 wherein said means for selectively adding or dropping clock pulses includes memory means storing a predetermined value corresponding to each possible octave, shift register means, means operative in response to clock signals for varying the contents of said shift register means in a predetermined manner, and means responsive to the contents of said shift register means reaching a predetermined value for causing a clock pulse to be added or dropped and for reloading the selected value from the memory means into the shift register means.

19. A tone generator system for a polyphonic musical instrument having a player-operated means for indicating the note or notes to be sounded, comprising:

a plurality of storage means, each adapted to store a coded representation of a single note to be sounded;

means responsive to an indication that a note is to be sounded for storing a coded representation of the note in a selected one of said storage means;

a source of a high frequency clock signal;

a separate programmable frequency divider for each of said storage means, each of said dividers being adapted to receive the clock signal and to divide the frequency of said signal by a factor which is a function of the code stored in the corresponding storage means to produce an output signal at the frequency of the note having its code stored in said storage means;

means for selectively causing pulses to be added to or dropped from the pulses coming from said high frequency clock signal source and applied to at least selected ones of said programmable dividers;

and means for causing the number of pulses added or dropped to be periodically increased and decreased at a vibrato rate, including a voltage controlled oscillator (VCO) the output from which is applied to control the adding or dropping of pulses, and means for modulating the control input to the said VCO at a lower frequency.

20. A tone generator system for a polyphonic musical instrument having player-operated means for indicating the note or notes to be sounded, comprising:

a plurality of storage means, each adapted to store a coded representation of a single note to be sounded;

means responsive to an indication that a note is to be sounded for storing a coded representation of the note in a selected one of said storage means;

a source of a high frequency clock signal;

a separate programmable frequency divider for each of said storage means, each of said dividers being adapted to receive the clock signal and to divide the frequency of said signal by a factor which is a function of the code stored in the corresponding storage means to produce an output signal at the frequency of the note having its code stored in said storage means;

and means for selectively causing pulses to be added to or dropped from the pulses coming from said high frequency clock signal source and applied to at least selected ones of said programmable dividers, including means for causing the number of pulses which are added or dropped during a given time interval to increase or decrease unidirectionally, whereby a pitch glide effect output is obtained.

21. A tone generator system as in claim 20 wherein said means for adding or dropping pulses includes a voltage controlled oscillator, (VCO), the output from which is utilized to control the adding or dropping of pulses, and a rising or falling ramp voltage source applied to the input of said VCO.

* * * * *